US009826791B2

(12) United States Patent
Adkins

(10) Patent No.: US 9,826,791 B2
(45) Date of Patent: Nov. 28, 2017

(54) HEAD GARMENT

(71) Applicant: Jennipher Adkins, Chicago, IL (US)

(72) Inventor: Jennipher Adkins, Chicago, IL (US)

( * ) Notice: Subject to any disclaimer, the term of this patent is extended or adjusted under 35 U.S.C. 154(b) by 0 days.

(21) Appl. No.: 14/949,268

(22) Filed: Nov. 23, 2015

(65) Prior Publication Data

US 2016/0073721 A1 Mar. 17, 2016

Related U.S. Application Data

(60) Division of application No. 13/525,915, filed on Jun. 8, 2012, now Pat. No. 9,192,202, which is a (Continued)

(51) Int. Cl.

| | |
|---|---|
| ***A42B 1/24*** | (2006.01) |
| ***A45D 8/40*** | (2006.01) |
| ***A41D 20/00*** | (2006.01) |
| ***A45D 8/00*** | (2006.01) |
| ***A42B 1/04*** | (2006.01) |
| ***A42B 1/06*** | (2006.01) |
| ***A45D 8/34*** | (2006.01) |
| ***A45D 8/36*** | (2006.01) |
| *A42C 5/02* | (2006.01) |
| *A42B 1/00* | (2006.01) |

(52) U.S. Cl.

CPC ..... *A42B 1/24* (2013.01); *A41D 20/00* (2013.01); *A42B 1/041* (2013.01); *A42B 1/062* (2013.01); *A45D 8/00* (2013.01); *A45D 8/34* (2013.01); *A45D 8/36* (2013.01); *A45D 8/40* (2013.01); *A42B 1/006* (2013.01); *A42C 5/02* (2013.01)

(58) Field of Classification Search

CPC ..... A42B 1/002; A42B 1/006; A42B 1/205; A42B 1/24; A42B 1/041; A42B 1/062; A42B 5/00; A42B 1/18; A45D 8/40; A45D 8/36; A45D 8/28; A45D 2008/006; A45D 2008/002; A45D 8/34; A45D 8/00; A41D 20/00; A41D 2023/004; A42C 5/02

USPC ..... 132/273, 274, 275, 101, 108; D28/41; 2/DIG. 11, 171, 181, 174, 195.7, 195.1, 2/200.1; D2/883, 867, 876, 882

See application file for complete search history.

(56) References Cited

U.S. PATENT DOCUMENTS 631,098 A * 8/1899 Stauber ..... A42B 7/00 132/101

715,600 A * 12/1902 Pomeroy ..... A42B 7/00 132/101

(Continued)

*Primary Examiner* — Amy Vanatta

(74) *Attorney, Agent, or Firm* — Brinks Gilson & Lione

(57) ABSTRACT

A head garment is provided that has a head band and at least one hair holding component. The head band is formed from an piece of material that is folded over on itself to provide inner and outer layers and a bottom edge. A top edge is formed by sewing the free edges of the layers together. Ends of the layers are also sewn together to provide a rear seam. The rear seam is provided with an opening through which the component can be extended when it is desired to be used, or which can be moved through the opening to be held between the layers when not desired to be used. The component being secured between the layers. An alternative head garment has a button attached to a rear of a head band for releasably securing a hair net thereto. Each head garment may include a visor if desired.

7 Claims, 23 Drawing Sheets

Related U.S. Application Data continuation-in-part of application No. 12/002,000, filed on Dec. 14, 2007, now abandoned.

(56) References Cited

U.S. PATENT DOCUMENTS 1,375,381 A * 4/1921 Golden ..... A45D 8/40 132/274
1,504,100 A * 8/1924 Danubio ..... A45D 8/40 132/274
1,518,049 A * 12/1924 Chocksee ..... A42B 1/041 2/200.1
1,594,206 A * 7/1926 Knapp ..... A45D 8/40 132/274
1,608,222 A * 11/1926 Lipper ..... A61F 9/045 2/12
2,110,811 A * 3/1938 Neaves ..... A45D 8/40 132/274
2,124,131 A * 7/1938 Ault ..... A45D 44/12 2/174
2,286,287 A * 6/1942 Livingston ..... A61F 9/045 2/174
D133,490 S * 8/1942 Burns ..... D2/867
D135,323 S * 3/1943 Liberatore ..... 2/195.1
2,651,310 A * 9/1953 Selson ..... A41G 5/0093 132/274
2,666,923 A * 1/1954 Berg ..... A42B 1/041 2/174
2,675,812 A * 4/1954 Berg ..... A45D 8/40 132/274
2,725,572 A * 12/1955 Marcellus ..... A42B 5/00 132/274
2,866,204 A * 12/1958 Mayer ..... A42B 1/041 2/174
2,884,645 A * 5/1959 Berg ..... A42B 1/043 132/274
3,348,240 A * 10/1967 Kohn ..... A45D 20/42 2/174
3,602,919 A * 9/1971 Piccione ..... A42B 5/00 2/207
4,998,544 A * 3/1991 Obergfell ..... A45D 8/36 132/212
5,046,195 A * 9/1991 Koritan ..... A41D 13/0512 2/172
5,105,476 A * 4/1992 Cox ..... A42B 1/064 2/12
5,174,312 A * 12/1992 Adams ..... A45D 8/00 132/130
5,239,705 A * 8/1993 Leopold ..... A41G 5/0093 132/273
D344,176 S * 2/1994 Lawrence ..... D2/875
5,293,884 A * 3/1994 Chapman ..... A45D 8/34 132/200
5,590,422 A * 1/1997 Henderson ..... A41D 20/00 132/273
5,675,840 A * 10/1997 Clavelle ..... A45D 44/12 2/174
5,706,836 A * 1/1998 McKeown ..... A42B 1/16 132/141
5,787,904 A * 8/1998 Michaud ..... A45D 8/34 132/128
D407,528 S * 3/1999 Goodman ..... D2/894
5,875,488 A * 3/1999 Milani ..... A42B 1/225 2/12
5,901,381 A * 5/1999 Nelson ..... A41D 20/00 2/171
D443,954 S * 6/2001 Blum ..... D28/41
6,421,838 B1 * 7/2002 Frank ..... A42B 1/225 2/174
D475,804 S * 6/2003 Stachowski ..... D28/41
6,688,316 B1 * 2/2004 Klug ..... A45D 8/00 132/275
7,293,566 B2 * 11/2007 Thall ..... A45D 8/40 132/274
D572,438 S * 7/2008 Chun ..... D2/883
D572,879 S * 7/2008 Marquardt ..... D2/867
D747,855 S * 1/2016 Corcoran ..... D2/875
2003/0121127 A1 * 7/2003 Walker ..... A41D 20/00 24/306
2006/0137074 A1 * 6/2006 Laing ..... A42B 7/00 2/195.2
2006/0143788 A1 * 7/2006 Presswood ..... A41D 20/00 2/181
2007/0094768 A1 * 5/2007 Moudgill ..... A42B 1/041 2/171
2009/0032044 A1 * 2/2009 Grimm ..... A45D 8/12 132/200

* cited by examiner 1100
191
195
193
197
196
157
127h
171

HEAD GARMENT

CROSS-REFERENCE AND PRIORITY CLAIM

This application is a divisional of U.S. patent application Ser. No. 13/525,915 (now U.S. Pat. No. 9,192,202), filed Jun. 18, 2012, which is a continuation-in-part of U.S. patent application Ser. No. 12/002,000, filed Dec. 14, 2007, and entitled "MULTI SHAPED, MULTIPURPOSE, VARIED-FABRIC HEAD BAND AND WRIST BAND ENCLOSURES AND HAIR CONTROL GARMENTS". The contents of U.S. patent application Ser. Nos. 12/002,000 and 13/525,915 (now U.S. Pat. No. 9,192,202) are hereby incorporated by reference in their entirety.

FIELD OF THE INVENTION

The invention relates to a stretchable head garment that comprises a band that is worn around the head (i.e., a sweat band) that has various attached hair holding components.

BACKGROUND OF THE INVENTION

There is always a need for active people to keep sweat and hair from the face and eyes during physical activity. This is commonly done with the use of a plain old sweat band. Although sweat bands keep sweat and hair from the eyes and face, they do not have hair holding abilities to further hold hanging hair (i.e., hair placed in a pony tail or loose). The present invention will allow users with longer hair lengths to further secure their hair during physical activity. This creates a head garment that also allows the hair to be shown, not covered, and to be hung in a comfortable position without the possibility of "becoming loose," thereby falling into the eyes and face.

People with active life styles also need convenience relative to carrying objects before, during and after physical activity. The current invention not only provides a hair holding multi-purpose head band, but one that can hold objects and hair in multiple positions. The unique design of the present invention also provides users a useful and convenient maintenance garment relative to flattening the short hair at the rear of the head.

The current invention also allows users the ability to change the color and hair holding component to the plain old sweat band by providing a top opening that allows users to place a plain old sweat band inside interior. This covering is interchangeable simply by opening an enclosure and removing the band.

Another common issue for active women is being able to comfortably have sun protection while wearing a head band, whereby a visor is connected to the head band. The fabric used for the headband is not bulky (i.e., terry cloth) and, therefore, the head band can be worn anytime, not only during sport activities. However, the current invention teaches a method of combining terry cloth fabric and other thinner fabrics, whereby only a section of the head band comprises terry cloth fabric.

The same issue exists with sweat bands wherein the only options available are terry cloth fabric. The present invention also allows for the production of a wrist band that comprises terry cloth on the interior side and a different fabric on the exterior.

The current market in head accessories worn during physical activity has seen very little innovation. Some of the most commonly used head garments are perhaps the baseball cap, beanie and the sweat band. The basic design of the sweat band can be worn by women and men and is highly effective in keeping sweat and hair out of eyes and face during physical or sport activity or during general use. The current invention covers innovations to the head band and head coverings.

SUMMARY OF THE INVENTION

The current invention is to provide a new method of production for head bands and wrist bands, whereby the functionality of a plain old head band and head coverings that comprises of unique designs and attached hair holding components, protection components, wrapping components and compartments where objects can be placed in and where multiple fabric types are sewn for strategic use and placement on the skin.

One object of the present invention is to provide a method of producing a wrist band whereby each side is comprised of different fabric, whereby the exterior fabric can be decorative, while the interior or underside fabric, which touches the skin to absorb sweat, will be terry cloth or any other performance, moisture-proof fabric.

One object of the current invention is to provide users with a head garment that allows for a comfortable design during physical activity that will not come off of the head, and that simultaneously secures long hair.

Another object of the current invention is to provide a head garment that will allow a user to expose as much hair and scalp as possible while simultaneously providing a secure "anchor and lock" for any excess hair, whereby, utilizing a hair holding component, excess hair is channeled to one location on the primary band unit, thereby containing hair and preventing hair from swinging.

Yet another objective to the present invention is to provide a plain old head band that is designed with varying widths, whereby the same band has a wider back portion (neck area) compared to the front portion (face area). A wider back portion will provide additional surface area to attach hair holding components for tucking hair and will also provide additional structure and position for tucked hair to rest upon while it is secure.

Another objective of the present invention is to provide a plain old head band that comprises various configurations, whereby the back portion, where threaded hair can rest, can be made to have different appearances (i.e., shaped, different material, etc. . . . ).

Yet another object to the present invention will allow the user to place objects inside various enveloped compartments (money, jewelry, stored music device) partially created by the folded material during production process in the production of a head band or wrist band.

Another object to the present invention is to allow the user the ability to envelope a plain old head band, whereby the user can change the color of a plain old head band by placing it inside a circumference opening provided in the present invention, thereby allowing the user to purchase just one thick head band, such that money can be saved.

Another object to the present invention will allow for quick and inexpensive production of the new design and additional functionality to the plain old head band. Whereby the base material is shaped and cut as one piece and comprises an additional section that further comprises a moisture resistant fabric type (i.e., terry cloth, fleece, dry weave). This will allow moisture resistant fabric to be used on the forehead section only while the band is worn, while exterior fabric can be used for the remaining parts of the band.

One advantage of the present invention is to provide a head garment that anchors hair that is first secured within a head band, that is already tied within a second hair holder (i.e., rubber band, hair tie, "Scrunchie") then finally the loose hair remaining from the second hair holder is then anchored as it is held within an attached hair holding component provided by the present invention.

Yet another object to the present invention allows users various options relative to the supplemental hair holding component. Where a range of options is provided, users can make an appropriate selection based on hair texture, length, thickness and style.

Another objective to the current invention is to provide a sun visor that can conform and be worn flipped down or flipped up and can be comprised of the same material of the head band it is attached to.

The flexible and reversible sun visor portion and band portion can be comprised of varied fabric panels whereby the user can opt to wear multiple compositions or appearances than the lower portion, thereby allowing the user to present alternative appearances when alternating the visor.

Another objective to the sun visor head band is the attachment of a ponytail holding component, whereby a strap, ribbons or interchangeable scarf is provided and extends from the head band.

Yet another objective of the present invention is to provide a primary head band that allows the user to interchange scarves through openings, thereby giving the user endless options of scarf choices.

These and other features and objects of the present invention will be more fully understood from the following detailed description of the preferred embodiments which should be read in light of the accompanying drawings.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
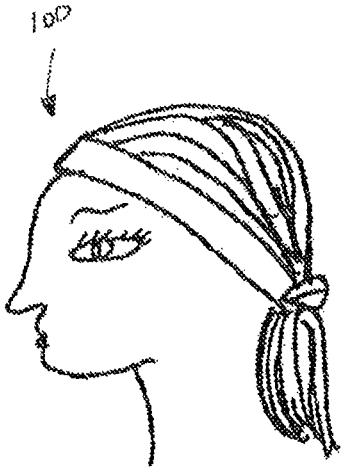
FIG. 1 is a side view illustrating an embodiment of a hair garment of the present invention being worn by a user.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

FIG. 1 shows a side view of a person wearing the head garment of the present invention. This illustrates a basic use of the present invention whereby the entire hair line is covered by a band that further comprises a hair holding component that allows user to secure hair.

A first embodiment of a head garment 100 of the present invention is described in relation to FIGS. 2-14, 16-18, 20-23, 25-30 and 34-38. A second embodiment of a hair garment 200 of the present invention is described in relation to FIGS. 72-75. A third embodiment of a hair garment 300 of the present invention is described in relation to FIGS. 15, 19 and 31-33. A fourth embodiment of a hair garment 400 of the present invention is described in relation to FIGS. 39-45 and 49-53. A fifth embodiment of a hair garment 500 of the present invention is described in relation to FIG. 24. A sixth embodiment of a hair garment 600 of the present invention is described in relation to FIGS. 46-48. A seventh embodiment of a hair garment 700 of the present invention is described in relation to FIGS. 60-65 and 78. An eighth embodiment of a hair garment 800 of the present invention is described in relation to FIGS. 66-71. A ninth embodiment of a hair garment 900 of the present invention is described in relation to FIGS. 54-59. A tenth embodiment of a hair garment 1000 of the present invention is described in relation to FIGS. 76 and 77. An eleventh embodiment of a hair garment 1100 of the present invention is described in relation to FIGS. 79-81. It is to be understood that like reference numerals used in describing the different embodiments is intended to be used to describe like elements of the different embodiments.

Figure 2:
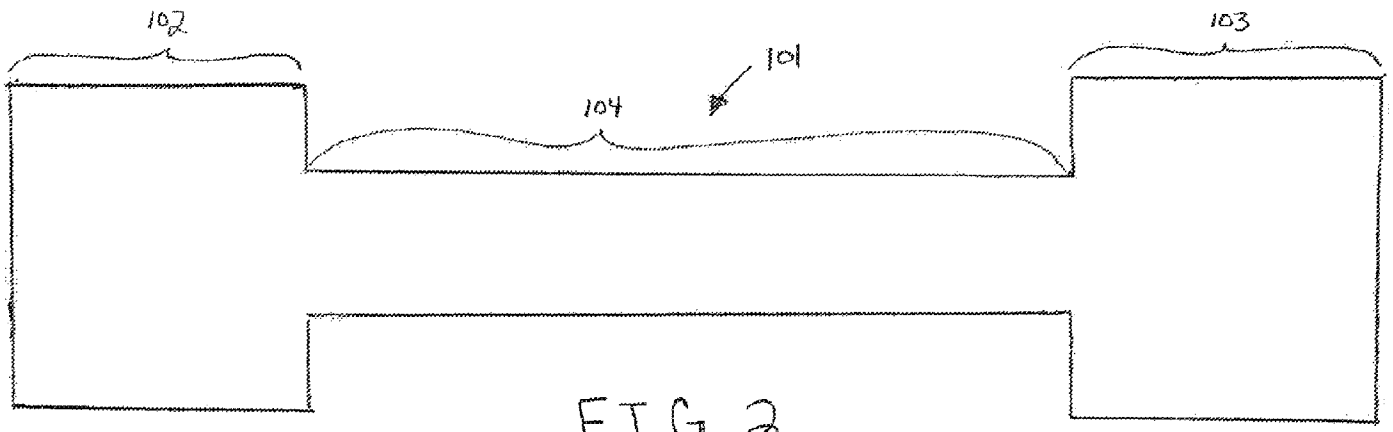
FIG. 2 is a front view of a piece of cut and unsewn material that is used to form a head band used in a first embodiment of the hair garment of the invention.
Figure 3:
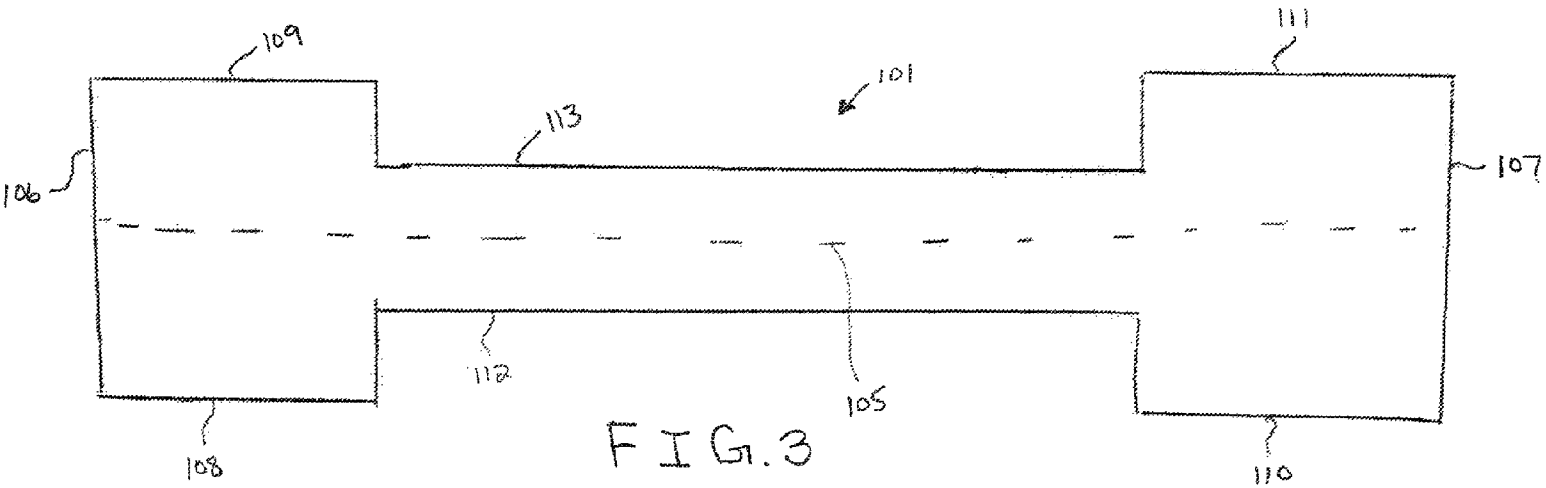
FIG. 3 is identical to FIG. 2, but shows a fold line that is provided about a center of the piece of material.

Attention is directed to FIGS. 2-14, 16-18, 20-23, 25-30 and 34-38 which illustrates the first embodiment of the head garment 100. FIG. 2 shows a single piece of stretchable fabric 101 where opposite end portions 102, 103 are connected to one another by an intermediate portion 104. The opposite end portions 102, 103 are preferably identical in configuration to one another and are wider than the intermediate portion 104. FIG. 3 shows the single piece of stretchable fabric 101 having a center fold line 105 which extends from a first free end 106 to a second free end 107 through the end portion 102, the intermediate portion 104, and the end portion 103. The stretchable fabric 101 is folded along the center fold line 105 such that a lower edge 108 of the end portion 102 is generally planar to an upper edge 109 of the end portion 102, such that a lower edge 110 of the end portion 103 is generally planar to an upper edge 111 of the end portion 13, and such that a lower edge 112 of the intermediate portion 104 is generally planar to an upper edge 113 of the intermediate portion 104, in order to form a sewn component 114, as is generally shown in FIG. 4.

Figures 4, 5, 6, 7, 8, 9, 10, 11:
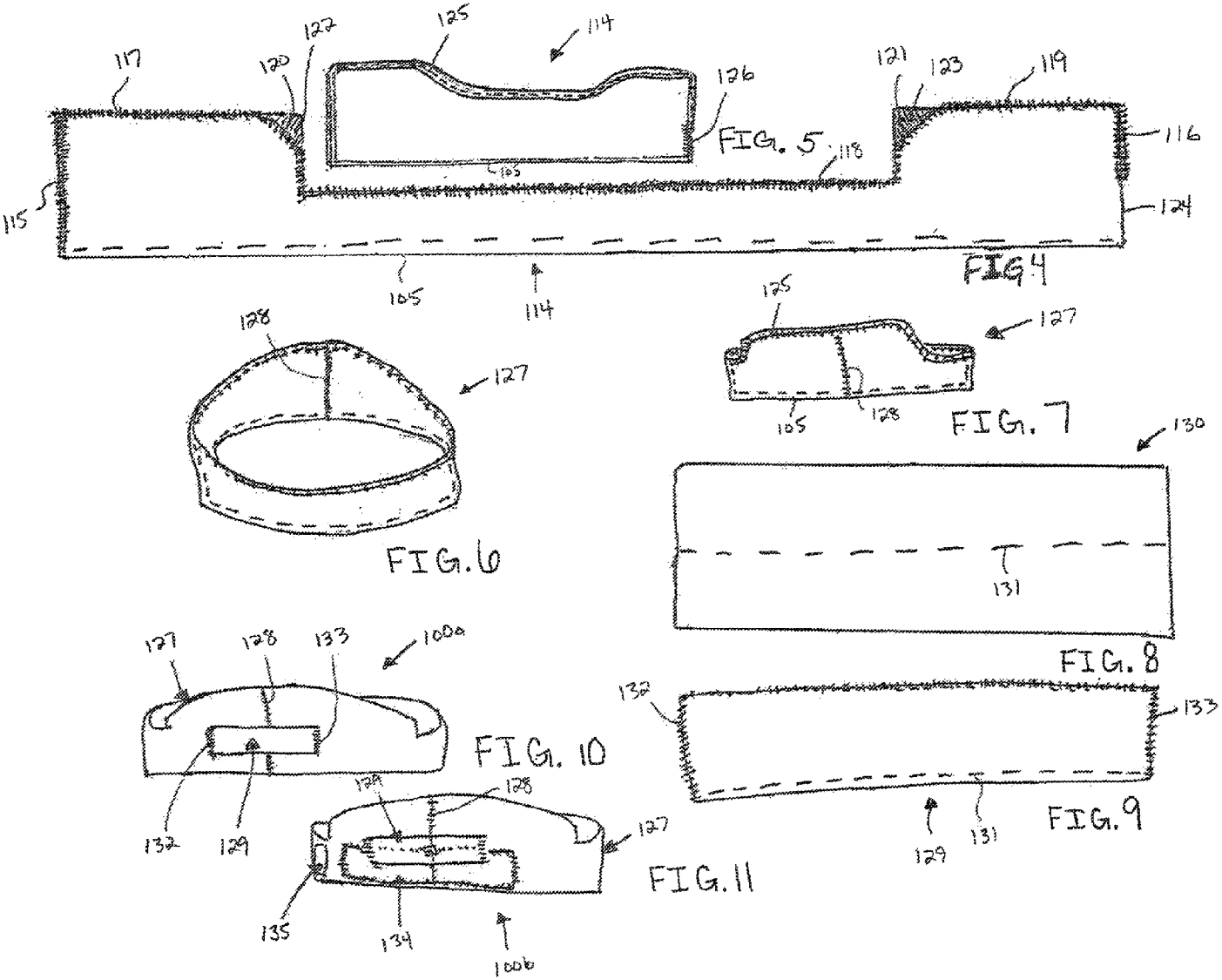
FIG. 4 is a side view illustrating the piece of material from FIG. 3 being folded about the fold line and being sewn about its edges.
FIG. 5 is a side view illustrating the piece of material from FIG. 4 being turned inside-out, such that the seams are hidden inside of folded material.
FIG. 6 is a perspective view of the piece of material from FIG. 13, being attached to itself to form the head band used in the first embodiment of the hair garment of the present invention.
FIG. 7 is a rear view of the piece of material from FIG. 5 being attached to itself to form the head band used in the first embodiment of the hair garment of the present invention.
FIG. 8 is a front view of a tuck band having a fold line about its center which is used to form a first version of the first embodiment of the hair garment of the present invention.
FIG. 9 is a front view illustrating the tuck band from FIG. 8 being folded about the fold line and being sewn about its edges.
FIG. 10 is a rear view of the first version of the first preferred embodiment of the hair garment of the present invention.
FIG. 11 is a rear view of a second version of the first preferred embodiment of the hair garment of the present invention.

FIG. 4 shows the sewn component 114 in an inside-out position with the center fold line 105 forming a bottom of the sewn component 114. FIG. 4 further shows that sewn component 114 is formed by sewing end seams 115, 116, top seams 117, 118, 119, and diagonal seams 120, 121. Diagonal seams 120, 121 are provided in order to create a rounded edge visible from the exterior. This is notable because the fabric is cut as a square edge to save time and minimize excess debris in the cutting process. When the diagonal seams 120, 121 are created, the remaining fabric 122, 123 becomes hidden in the seam, as the final shape of the sewn component 114 will be dictated by the diagonal seams 120, 121. A small opening 124 is left in end seam 116 in order to allow the sewer to reverse the visibility of the raw seams by pulling an interior portion of the inside-out sewn component 114 shown in FIG. 4 through the opening 124, thereby making the interior portion of the inside-out sewn component 114 the exterior portion of the sewn component 114 as shown in FIG. 5.

FIG. 5 shows the sewn component 114 with all raw seams 115, 116, 117, 118, 119, 120, 121 hidden within the interior of the folded fabric. The exterior seam is a finished seam 125 that becomes visible after the sewer pulls the interior portion of the inside-out sewn component 114 through the opening 124. When the sewn component 114 is completely reversed through the opening 124, the sewer then sews the opening 124 at 126 in order to completely enclose the interior portion of the sewn component 114.

FIG. 7 shows the head band 127 which is formed by sewing the free ends of the sewn component 114, as illustrated in FIG. 5, together to form seam 128.

FIGS. 6 and 12-14 show an alternative of the head band 127 and the formation thereof, compared to FIGS. 2-5 and 7, where the only difference is that the shape of the lower and upper edges 108, 110; 109, 112 of the end portions 102, 103 are curved, rounded and/or angled, rather than squared, such that the sewing of the diagonal seams 120, 121 is not provided for.

With the head band 127 formed, various different hair holding components can be added to the head band 127 in order to provide the head garment 100 of the present invention.

A first version of the head garment 100 that can be formed is described and illustrated with regard to FIGS. 8-10 and will be referenced as head garment 100*a*. Head garment 100*a* provides for a tuck band 129 (the hair holding component) to be secured to the head band 127. The tuck band 129 is preferably formed by providing for a cut-out, generally rectangular piece of material 130 having a center fold line 131, as illustrated in FIG. 8. The piece of material 130 is folded along the center fold line and is sewn along its edges in order to form the tuck band 129, as illustrated in FIG. 9 The free ends 132, 133 of the tuck band 129 are then secured to, preferably by sewing, to the exterior portion of the head band 127, with the free end 132 being sewn proximate one side of the seam 128 and the free end 133 being sewn on the opposite side of, but proximate to, the seam 128, as illustrated in FIG. 10. The tuck band 129 thus covers a portion of the seam 128. With the head garment 100*a* formed, a user will have the ability to place the head band 127 onto her head and then place her hair through the tuck band 129 while the head band 127 is worn around the head.

A second version of the head garment 100 that can be formed is described and illustrated with regard to FIG. 11 and will be referenced as head garment 100*b*. Head garment 100*b* is identical to head garment 100*a*, but further includes enveloped compartments 134, 135 that can hold objects. These enveloped compartments 134, 135 are created by sewing material to the head band 127, but leaving an opening that allows access to the compartments 134, 135. A user can then place small objects (i.e., folded money, jewelry, etc.) or a small stored music device (i.e., Nano, MP3, etc.) inside for hands-free convenience.

Figures 12, 13, 14, 15, 16:
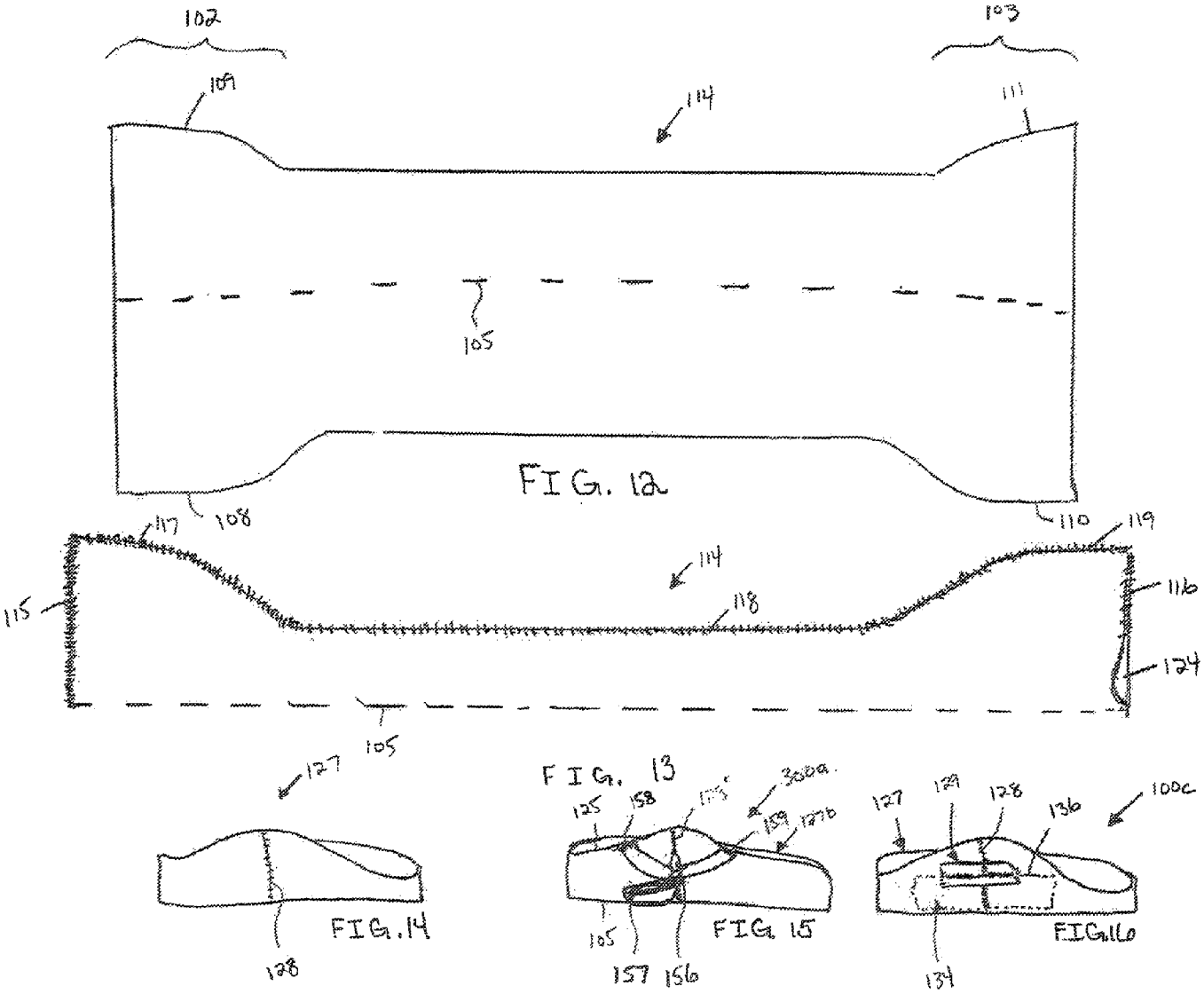
FIG. 12 is a front view of a piece of cut and unsewn material that is used to form an alternative head band used in a first embodiment of the hair garment of the invention.
FIG. 13 is a side view illustrating the piece of material from FIG. 12, which is turned inside-out, such that the seams are hidden inside of folded material, and which is attached to itself.
FIG. 14 is a rear view of the piece of material from FIG. 13 being attached to itself to form the alternative head band used in the first embodiment of the hair garment of the present invention.
FIG. 15 is a rear view of a first version of a third preferred embodiment of the hair garment of the present invention.
FIG. 16 is a rear view of a third version of the first preferred embodiment of the hair garment of the present invention.

A third version of the head garment 100 that can be formed is described and illustrated with regard to FIG. 16 and will be referenced as head garment 100*c*. Head garment 100*c* is identical to head garment 100*a*, but further includes a mechanism 136 (i.e., small zippers, buttons, etc.) which allows for the opening of the compartment 134 or 135 to be closed.

Figure 17:
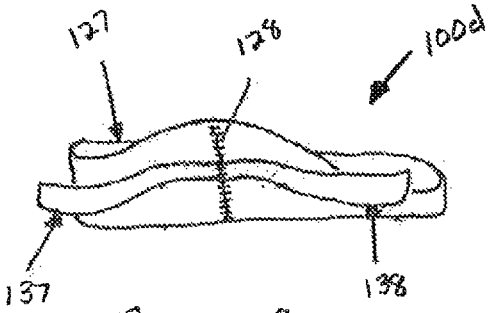
FIG. 17 is a rear view of a fourth version of the first preferred embodiment of the hair garment of the present invention.

A fourth version of the head garment 100 that can be formed is described and illustrated with regard to FIG. 17 and will be referenced as head garment 100*d*. Head garment 100*d* provides for a pair of ribbons 137, 138 (the hair holding components) to be secured to the head band 127. Each ribbon 137, 138 has one end which is secured to the head band 127 at the seam 128, preferably by sewing. With the head garment 100*d* formed, a user will have the ability to place the head band 127 onto her head and then tie the ribbons 137, 138 around her hair while the head band 127 is worn around the head.

Figure 18:
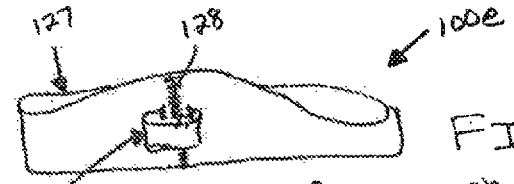
FIG. 18 is a rear view of a fifth version of the first preferred embodiment of the hair garment of the present invention.

A fifth version of the head garment 100 that can be formed is described and illustrated with regard to FIG. 18 and will be referenced as head garment 100*e*. Head garment 100*e* provides for a wide, generally circular loop 139 (the hair holding component) to be secured to the head band 127. The circular loop 139 has free ends that are secured to, preferably by sewing, to the exterior portion of the head band 127, with one of the free ends being sewn proximate one side of the seam 128 and the other free end being sewn on the opposite side of but proximate to, the seam 128. The loop 139 thus covers a portion of the seam 128. With the head garment 100*e* formed, a user will have the ability to place the head band 127 onto her head and then place her hair through the loop 139 white the head band 127 is worn around the head.

Figure 20:
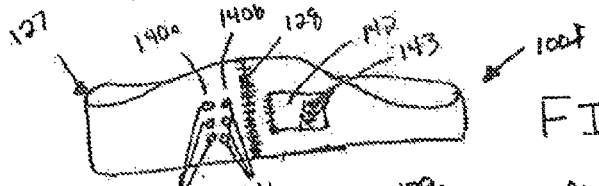
FIG. 20 is a rear view of a sixth version of the first preferred embodiment of the hair garment of the present invention.

A sixth version of the head garment 100 that can be formed is described and illustrated with regard to FIG. 20 and will be referenced as head garment 100*f*. Head garment 100*f* provides a multi-positional attaching mechanism to secure hair which includes rows 140*a*, 140*b* of fastening components 141 and a band 142 having fastening components 143 provided thereon. The fastening components 143 are complementary to the fastening components 141. An end of the band 142 is secured to, preferably by sewing, to the exterior portion of the head band 127, with the end being sewn proximate one side of the seam 128. The rows 140*a*, 140*b* are preferably provided on the opposite side of, but proximate to, the seam 128. A user is able to secure hair by placing hair onto the area of the seam 128 of the head band 127, wrapping the band 142 around the hair, and connecting the fastening components 143 on the band 142 to one of the rows 140*a*, 140*b* of the fastening components 141. The user is thus able to select multiple positions to connect the band 142.

Figure 21:
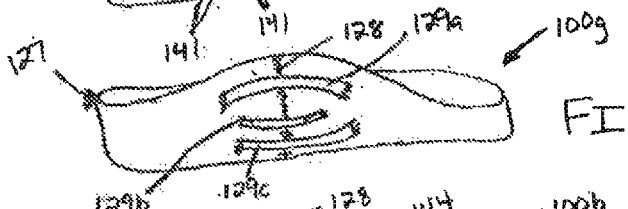
FIG. 21 is a rear view of a seventh version of the first preferred embodiment of the hair garment of the present invention.

A seventh version of the head garment 100 that can be formed is described and illustrated with regard to FIG. 21 and will be referenced as head garment 100*g*. Head garment 100*g* is similar to head garment 100*a*, except that head garment 100*g* provides multiple tuck bands 129*a*, 129*b*, 129*c* instead of only a single tuck band 129. With head garment 100*g*, the user is able to tuck hair in all or some of the bands 129*a*, 129*b*, 129*c*. The head garment 100*g* also allows the user to thread hair "under and over" (e.g., under band 129*a*, over band 129*b*, under band 129*c*) to create a more secure hold for the hair by implementing a "basket weave" technique.

Figure 22:
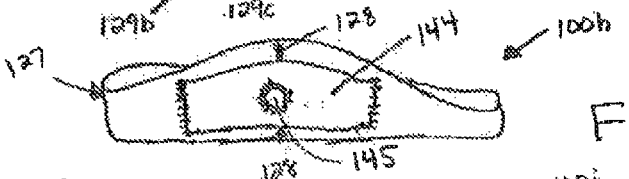
FIG. 22 is a rear view of an eighth version of the first preferred embodiment of the hair garment of the present invention.

An eighth version of the head garment 100 that can be formed is described and illustrated with regard to FIG. 22 and will be referenced as head garment 100*h*. Head garment 100*h* is similar to head garment 100*a*, except that the tuck band 144 is preferably extra wide and further comprises a stretchable opening 145 provided therethrough. The tuck band 144 allows the user to pull hair through the stretchable opening 145.

Figure 23:
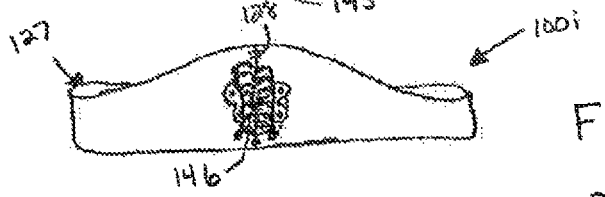
FIG. 23 is a rear view of a ninth version of the first preferred embodiment of the hair garment of the present invention.

A ninth version of the head garment 100 that can be formed is described and illustrated with regard to FIG. 23 and will be referenced as head garment 100*i*. Head garment 100*i* includes a hair holding apparatus 146 (e.g., a clamp, a barrette, etc.) which is securely attached/mounted to the back of the head band 127 at or proximate to the seam 128. A user is able to open the hair holding apparatus 146 in order to place hair in the hair holding apparatus 146 or to remove hair from the hair holding apparatus 146.

Figure 25:
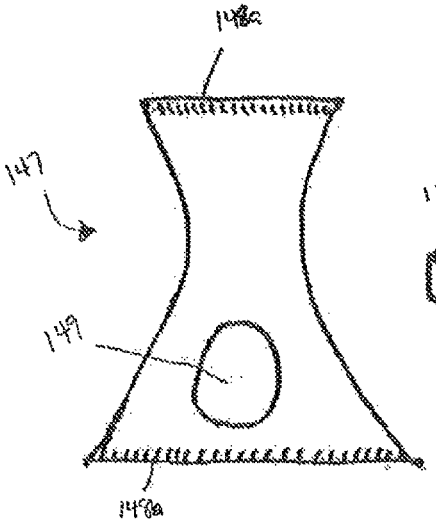
FIG. 25 is a side view of a top band used in a tenth version of the first preferred embodiment of the hair garment of the present invention.
Figure 26:
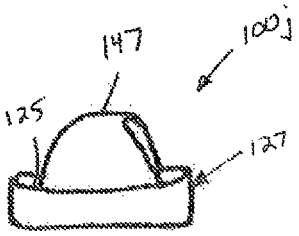
FIG. 26 is a front view of the tenth version of the first preferred embodiment of the hair garment of the present invention.
Figure 27:
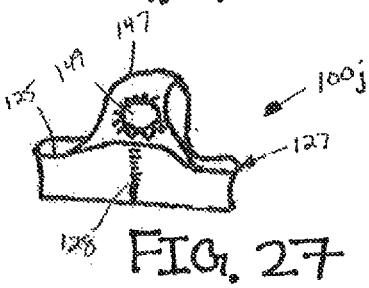
FIG. 27 is a rear view of the tenth version of the first preferred embodiment of the hair garment of the present invention.

A tenth version of the head garment 100 that can be formed is described and illustrated with regard to FIGS. 25-27 and will be referenced as head garment 100*j*. Head garment 100*j* provides for a top band 147 having opposite edges 148*a*, 148*b*. The top band 147 generally has a bow-tie like configuration as it is skinnier at its middle than at its edges 148*a*, 148*b*. An opening 149 is provided through the top band 147, preferably proximate to the edge 148*b* and distal from the edge 148*a*. The edges 148*a*, 148*b* are then secured, preferably by sewing, to the exterior top seam 125. The edge 148*b* is preferably sewn to the exterior top seam 125 proximate to the seam 128, as illustrated in FIG. 27. The top band 147 allows the user to place hair through the opening 149 while wearing the head garment 100*j*.

Figure 28:
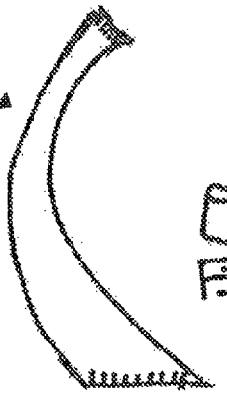
FIG. 28 is a side view of a top band used in an eleventh version of the first preferred embodiment of the hair garment of the present invention.
Figure 29:
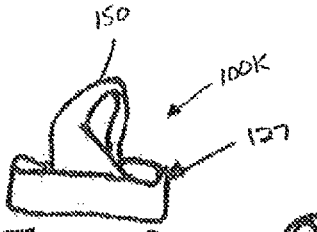
FIG. 29 is a front view of the eleventh version of the first preferred embodiment of the hair garment of the present invention.
Figure 30:
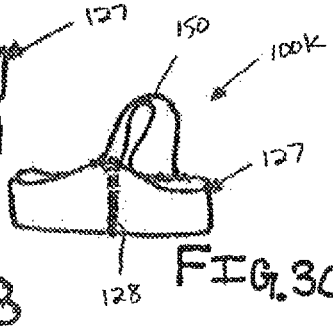
FIG. 30 is a rear view of the eleventh version of the first preferred embodiment of the hair garment of the present invention.

An eleventh version of the head garment 100 that can be formed is described and illustrated with regard to FIGS. 28-30 and will be referenced as head garment 100*k*. Head garment 100*k* is similar to head garment 100*j*, but the top band 150 of head garment 100*k* is preferably not formed in a bow-tie like configuration and does not have an opening provided therethrough.

Figure 34:
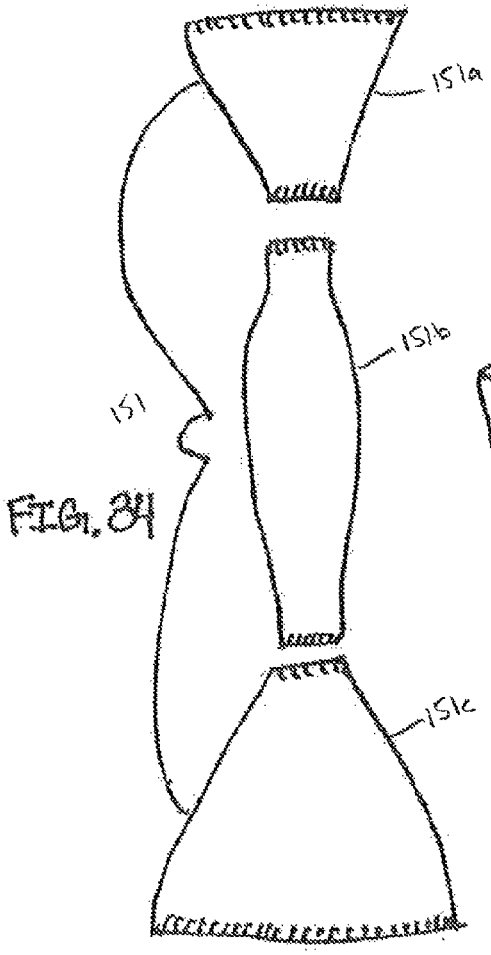
FIG. 34 is an exploded perspective view of a top band used in a twelfth version of the first preferred embodiment of the hair garment of the present invention.
Figure 36:
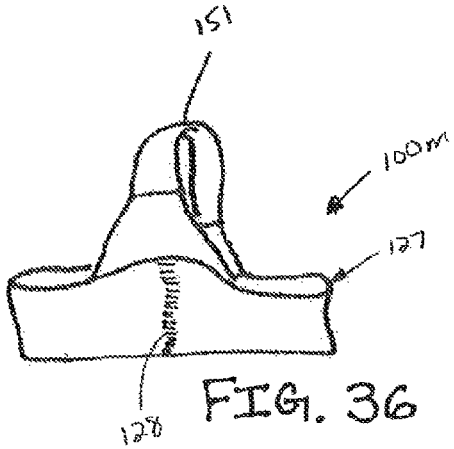
FIG. 36 is a rear view of a twelfth version of the first preferred embodiment of the hair garment of the present invention.
Figure 35:
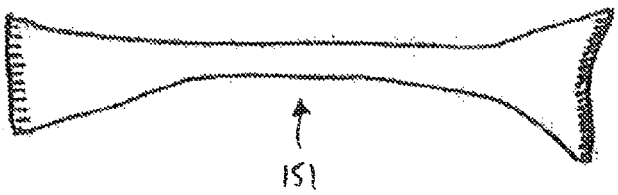
FIG. 35 is a perspective view of an extra-large head band attachment used in the twelfth version of the first preferred embodiment of the hair garment of the present invention.
Figure 40:
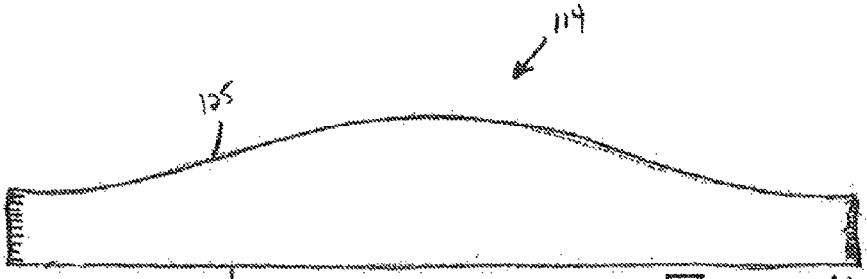
FIG. 40 is a front view of the piece of material from FIG. 39 which is folded about the fold line.
Figure 39:
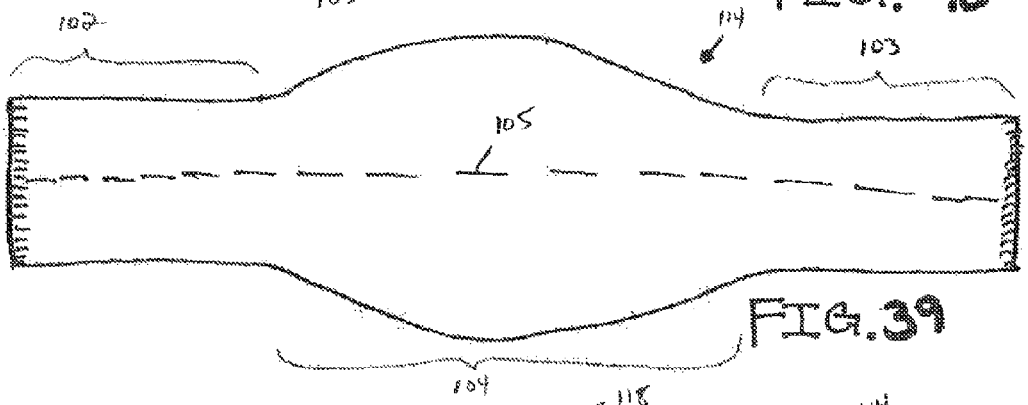
FIG. 39 is a front view of a piece of cut and unsewn material that is used to form a head band used in a first version of a fourth preferred embodiment of the hair garment of the invention.

A twelfth version of the head garment 100 that can be formed is described and illustrated with regard to FIGS. 34-36 and will be referenced as head garment 100*m*. Head garment 100*m* is similar to head garment 100*j*, but the top band 151 of head garment 100*m* does not have an opening provided therethrough. As illustrated in FIGS. 34 and 36, the top band 151 can be formed of three separate parts 151*a*, 151*b*, 151*c* that are secured together to form the top band 151 or, alternatively, as illustrated in FIG. 35, the top band 151 can be formed of a single part. With the top band 151 being formed in three separate parts 151*a*, 151*b*, 151*c*, a user could mix and match the location and configuration of the different parts of the top band 151 to allow for more variation.

Figure 38:
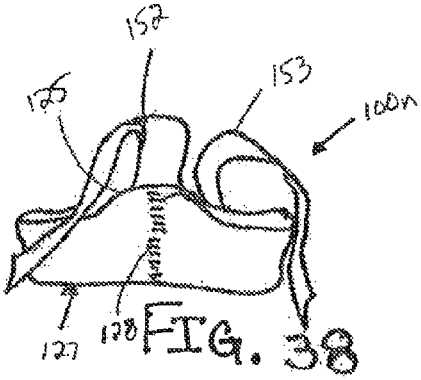
FIG. 38 is a rear view of the thirteenth version of the first preferred embodiment of the hair garment of the present invention.
Figure 37:
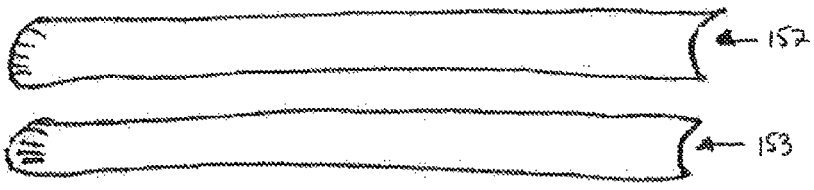
FIG. 37 shows a perspective view of tying strips used in a thirteenth version of the first preferred embodiment of the hair garment of the present invention.

A thirteenth version of the head garment 100 that can be formed is described and illustrated with regard to FIGS. 37 and 38 and will be referenced as head garment 100*n*. Head garment 100*n* is similar to head garment 100*k*, except that rather than a continuous top band 150, the head garment 100*n* is provided with two straps 152, 153, with one strap 152 being secured to the top exterior seam 125 proximate to the seam 128 and the other strap 153 being secured to the top exterior seam 125 distal from the seam 128.

Figure 72:
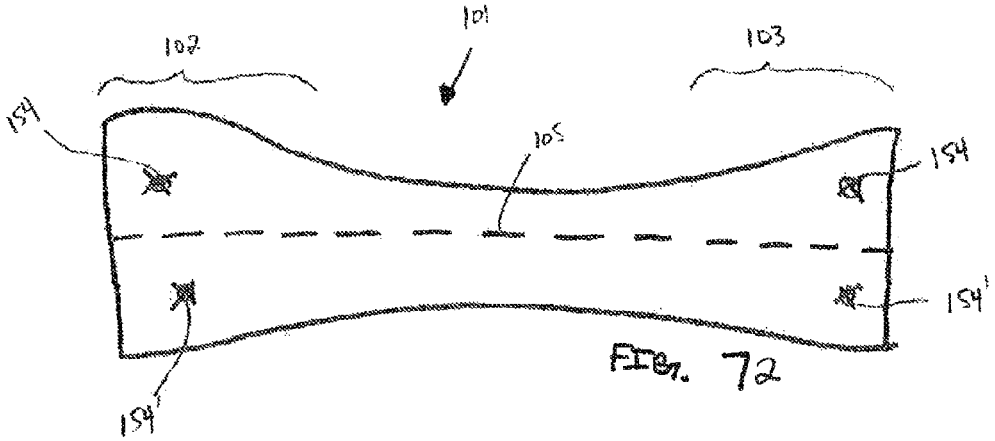
FIG. 72 is a front view of an unsewn piece of material used to form a head band used to form a second preferred embodiment of the hair garment of the invention.
Figure 73:
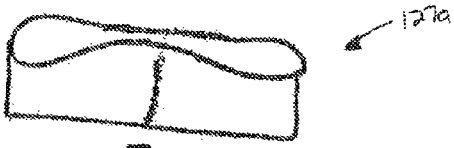
FIG. 73 is a perspective view of the head band used to form the second preferred embodiment of the hair garment of the invention.
Figure 74:
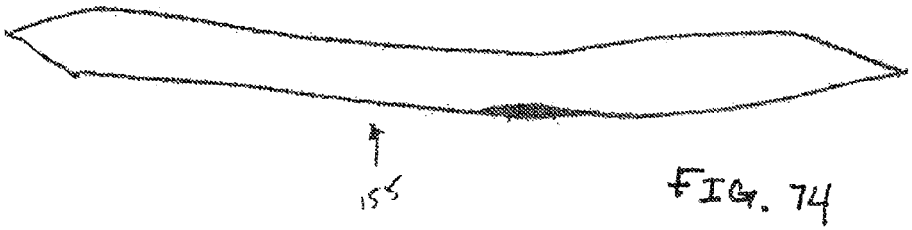
FIG. 74 is a side view of an extra-long scarf used to form the second preferred embodiment of the hair garment of the invention.
Figure 75:
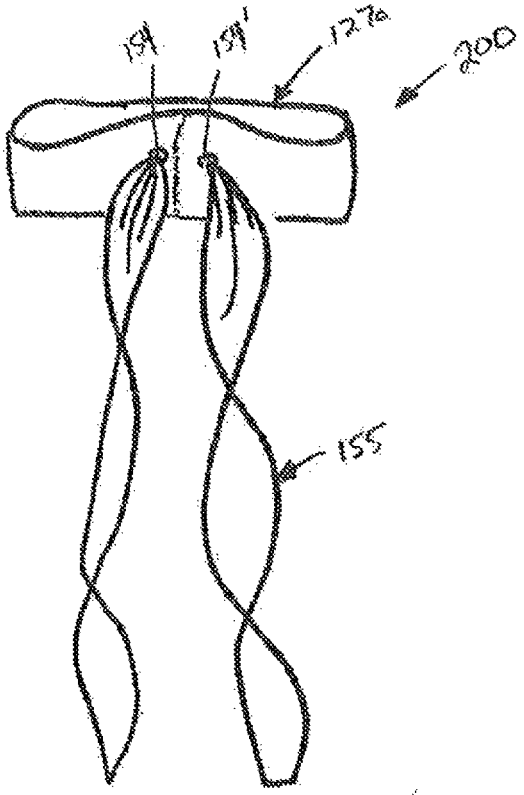
FIG. 75 is a perspective view of the second preferred embodiment of the hair garment of the invention.

Attention is directed to FIGS. 72-75 which illustrate the second embodiment of the head garment 200. The head band 127*a* of head garment 200 is identical to the head band 127 of head garment 100, except that headband 127*a* is formed with apertures 154, 154' provided through the end portions 102, 103 of the piece of material 101, as illustrated in FIG. 72. The apertures 154 are provided on an opposite side of the center told line 105 from the apertures 154' such that when the piece of material 101 is folded along the center fold line 105, the apertures 154 are matched to the apertures 154'. With the headband 127*a* formed, as illustrated in FIG. 73, the head garment 200 is formed by threading an extra-long scarf 155, as illustrated in FIG. 74, through the apertures 154, 154', as illustrated in FIG. 75.

Attention is directed to FIGS. 15, 19 and 31-33 which illustrate the third embodiment of the head garment 300. The head band 127*b* of head garment 300 is identical to the head band 127 of head garment 100, except that the seam 128' connecting the free ends of the outer layer of the sewn component of head band 127*b* does not extend all the way from the finished seam 125 to the fold 105. Rather, the seam 128' is interrupted between the finished seam 125 and the fold 105 to provide an opening 156 that provides access to a space defined between the inner and outer layers of the head band 127*b*.

Figure 32:
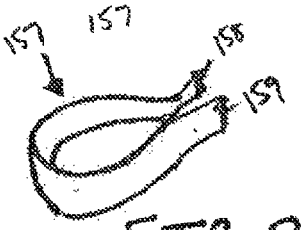
FIG. 32 is a perspective view of a hair holding component used in the first version of the third embodiment of the hair garment of the invention.
Figure 33:
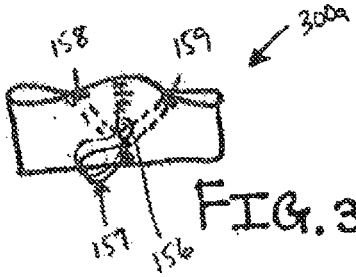
FIG. 33 is a rear view of the first version of the third preferred embodiment of the hair garment of the present invention.

A first version of the head garment 300 that can be formed is described and illustrated with regard to FIGS. 15, 32 and 33 and will be referenced as head garment 300*a*. The opening 156 of head band 127*b* allows for a hair holding component 157, (such as a ribbon, a strap, a band, a string, or a scarf, for example) to extend out of the opening 156 so that a user can hold her hair with it. The free ends 158, 159 of the component 157 are secured to the finished seam 125, preferably on opposite sides of seam 128' as shown, and between the inner and outer layers. Because the component 157 is secured to the seam 128' between the inner and outer layers, and because the opening 156 is provided, the component 157 can alternatively be used to hold hair when it extends out of the opening 156, or it can be inserted back into the opening 156 and held in place, out of sight, between the inner and outer layers, if desired.

Figure 19:
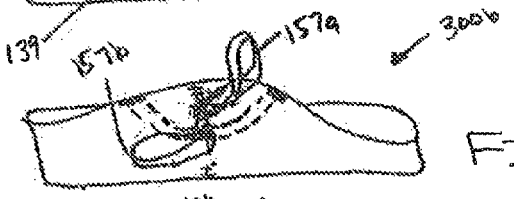
FIG. 19 is a rear view of a second version of the third preferred embodiment of the hair garment of the present invention.

A second version of the head garment 300 that can be formed is described and illustrated with regard to FIG. 19 and will be referenced as head garment 300*b*. Head garment 300*b* is identical to head garment 300*a*, except that rather than a single hair holding component being provided, head garment 300*b* utilizes an upper hair holding component 157*a* and a lower hair holding component 157*b*. Each component 157*a*, 157*b* has its free ends 158, 159 secured to the finished seam 125, either on opposite sides of seam 128' or on the same side of seam 128', with component 157*a* having both ends 158, 159 being attached to one side of seam 128' and component 157*b* having both ends 158, 159 being attached to the other side of seam 128'. The upper component 157*a* is preferably wider than the lower component 157*b* so that the head garment 300*b* can easily accommodate a user with thick hair by allowing more hair to initially enter, thereby providing a greater allowance where it is needed the most, then narrows as most hair ends narrow.

Figure 31:
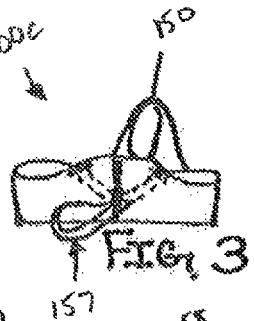
FIG. 31 is a rear view of a third version of the third preferred embodiment of the hair garment of the present invention.

A third version of the head garment 300 that can be formed is described and illustrated with regard to FIG. 31 and will be referenced as head garment 300*c*. Head garment 300*c* is identical to head garment 300*a*, except that head garment 300*c* further includes a top band 150 of the type used in head garment 100*k*.

Attention is directed to FIGS. 39-45 and 49-53 which illustrate the fourth embodiment of the head garment 400. The head band 127*c* of head garment 400 is identical to the head band 127 of head garment 100, except that the intermediate portion 104 is wider than the opposite end portions 102, 103. The intermediate portion 104 may also have rounded edges similar to the rounded edges of the end portions 102, 103, as illustrated in FIG. 6. Such a structure of the head band 127*c* provides the user with a large head support area.

Figure 41:
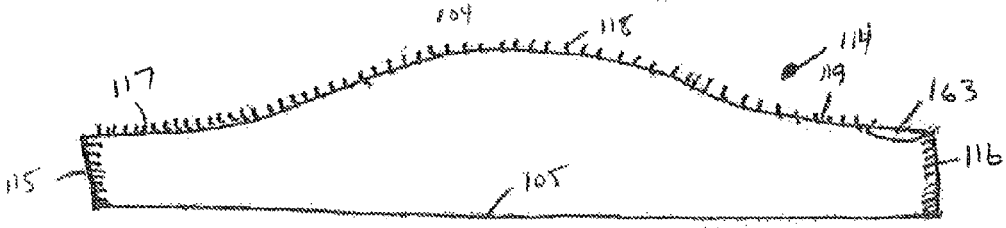
FIG. 41 is a front view of the piece of material from FIG. 40 which is sewn along its edges.
Figure 42:
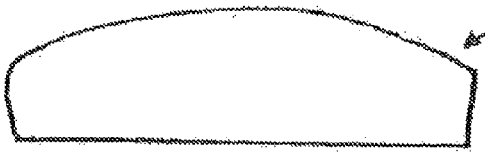
FIG. 42 is a front view of an insert.
Figure 43:
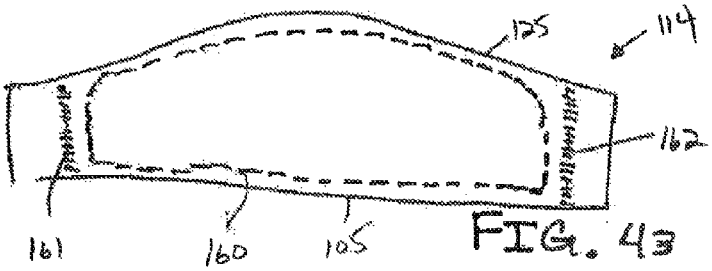
FIG. 43 is a rear view of a head band used in the fourth preferred embodiment of the hair garment of the invention which includes the insert in dotted line.
Figure 44:
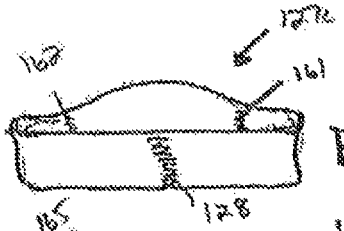
FIG. 44 is a front view of the head band used in the fourth preferred embodiment of the hair garment of the invention.

Optionally, the large head support area of the head band 127*c* can also house an additional support 160, which is illustrated in FIG. 42. When the additional support 160 is enclosed between the inner and outer layers, the additional support 160 can be sealed in place by sewing the inner and outer layers together at sewn seams 161, 162. This is partially accomplished by leaving an opening 163 in sewn seam 119, whereby sewer is able to reverse the seams, as shown in FIGS. 41 and 43. FIG. 44 shows the head band 127*c* which is formed by sewing the free ends of the sewn component 114 together to form seam 128. When a user wears the head band 127*c*, the seam 128 is intended to be provided on the front of the person's head, such that the back and sides of the head band 127*c* remain seamless.

Figure 45:
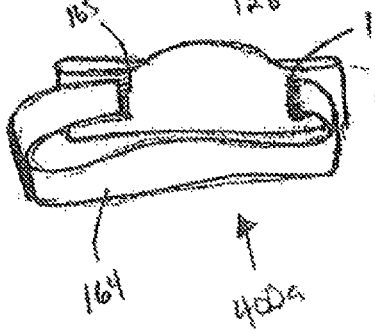
FIG. 45 is a rear view of the first version of the fourth preferred embodiment of the hair garment of the invention.

A first version of the head garment 400 that can be formed is described and illustrated with regard to FIG. 45 and will be regarded as head garment 400*a*. Head garment 400*a* provides for an extra-large band 164 to be connected at its free ends 165, 166 to the back side of the head band 127*c*. The ends 165, 166 are preferably separated from one another, as illustrated in FIG. 45.

Figure 49:
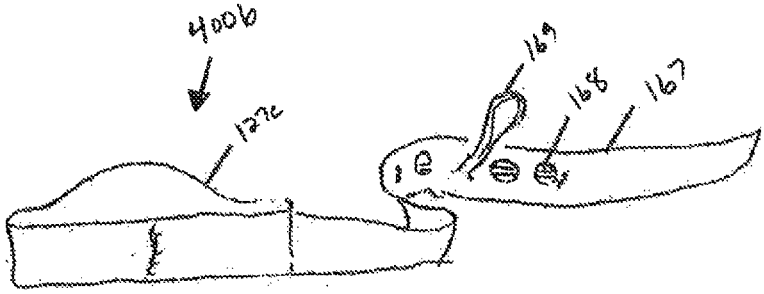
FIG. 49 is a front view of a second version of the fourth preferred embodiment of the hair garment of the invention.
Figure 52:
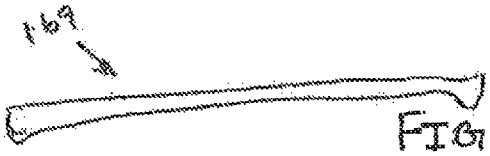
FIG. 52 is a side view of a tying string which can be used in the fourth preferred embodiment of the hair garment of the invention.
Figure 51:
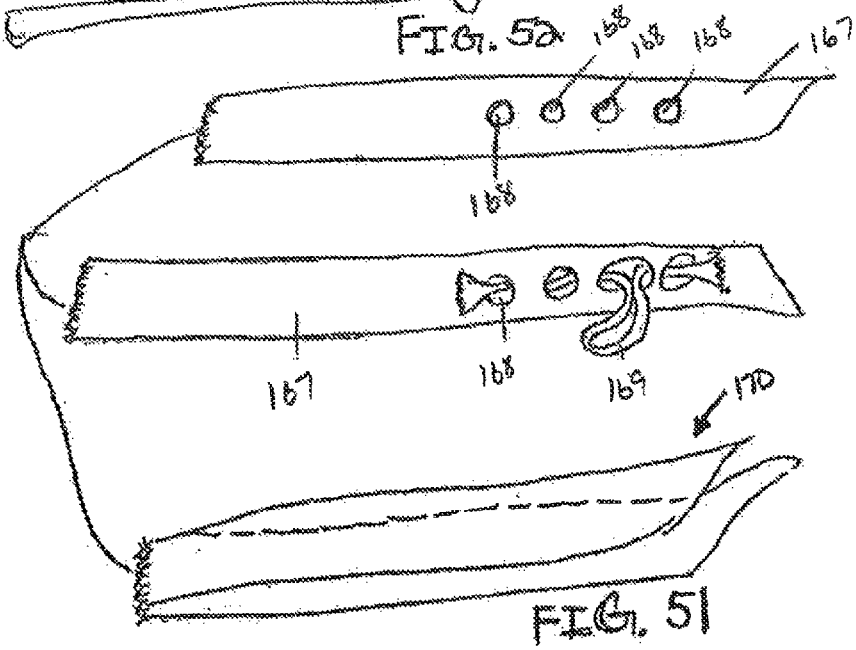
FIG. 51 shows various versions of a wrapping scarf which can be used in the fourth preferred embodiment of the hair garment of the invention.
Figure 54:
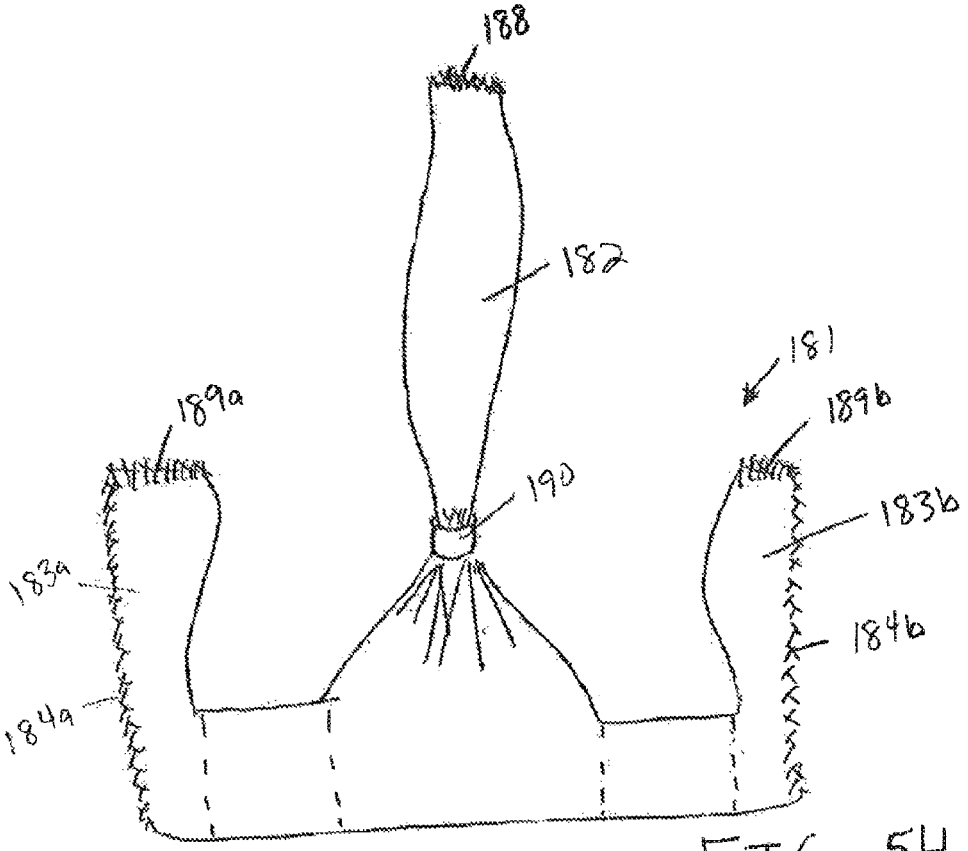
FIG. 54 is a perspective view of an unfolded, unsewn piece of material which is used to form a ninth preferred embodiment of the head garment of the invention.
Figure 57:
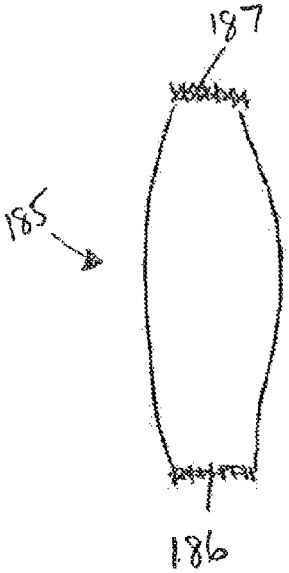
FIG. 57 is a perspective view of an unfolded, unsewn top band which is used to form the ninth preferred embodiment of the head garment of the invention.
Figure 55:
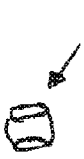
FIG. 55 is a perspective view of an adjusting bead used to form the ninth preferred embodiment of the head garment of the invention.
Figure 56:
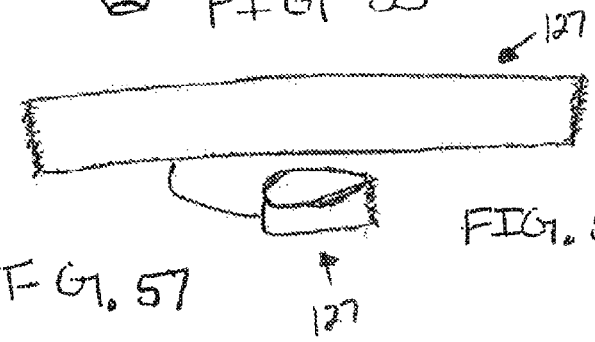
FIG. 56 illustrates a head band which may optionally be included in the ninth preferred embodiment of the head garment of the invention.

A second version of the head garment 400 that can be formed is described and illustrated with regard to FIGS. 49, 51 and 52 and will be regarded as head garment 400*b*. Head garment 400*c* provides for a wrapping scarf 167 having apertures 168 provided therethrough through which a tying string 169 can be woven through. The wrapping scarf 167 is preferably secured to one side of the head band 127*c*.

Figure 50:
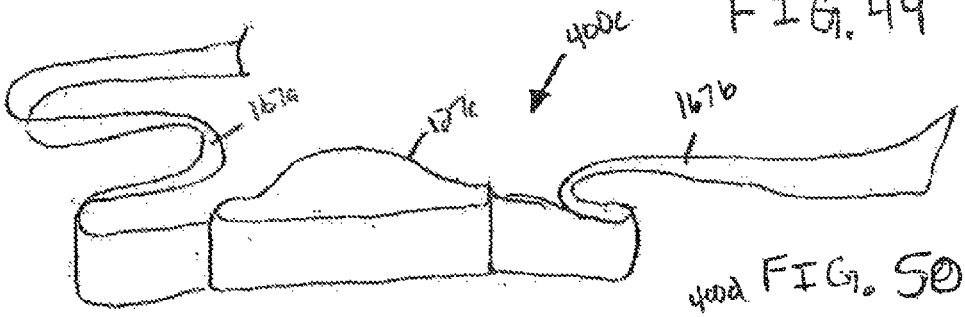
FIG. 50 is a front view of a third version of the fourth preferred embodiment of the hair garment of the invention.

A third version of the head garment 400 that can be formed is described and illustrated with regard to FIG. 50 and will be regarded as head garment 400*c*. Head garment 400*c* provides for a pair of wrapping scarves 167*a*, 167*b* to be secured to opposite sides of the head band 127*c*. The wrapping scarves 167*a*, 167*b* preferably are not provided with the apertures 168.

Figure 53:
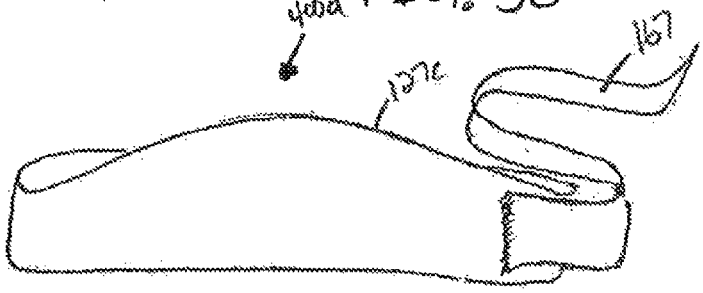
FIG. 53 is a rear view of a fourth version of the fourth preferred embodiment of the hair garment of the invention.

A fourth version of the head garment 400 that can be formed is described and illustrated with regard to FIG. 53 and will be regarded as head garment 400*d*. Head garment 400*d* is preferably identical to head garment 400*b*, except that the wrapping scarf 167 is not provided with either the apertures 168 or the tying string 169.

If desired, as illustrated in FIG. 51, any of the wrapping scarves 167, 167*a*, 167*b* could be provided as a double scarf 170.

Figure 24:
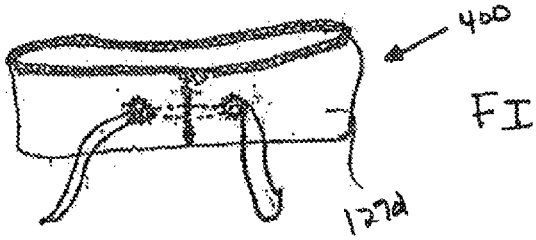
FIG. 24 is a rear view of a fifth embodiment of the hair garment of the present invention.

Attention is directed to FIG. 24 which illustrates the fifth embodiment of the head garment 500. The head garment 500 is generally identical to the head garment 200 except that the head band 127*d* is not provided with the finished seam 125 and the top edge of the head band 127*d* is generally planar, rather than having a raised portion. Instead, the top edge of the head band 127*d* is open and a fastening mechanism, such as a zipper, is provided to open and close the circumference opening. Thus, a user is able to completely open the envelopment to the head band 127*d* to allow a user to place objects inside or place a plain old sweat band inside. Thus, the head band 127*d* can act as a replaceable cover to a plain old sweat band, where the plain old sweat band can be used as a base band, and the head band 127*d* can provide a covering to provide multiple colors and hair holding options to the plain old sweat band.

Figure 46:
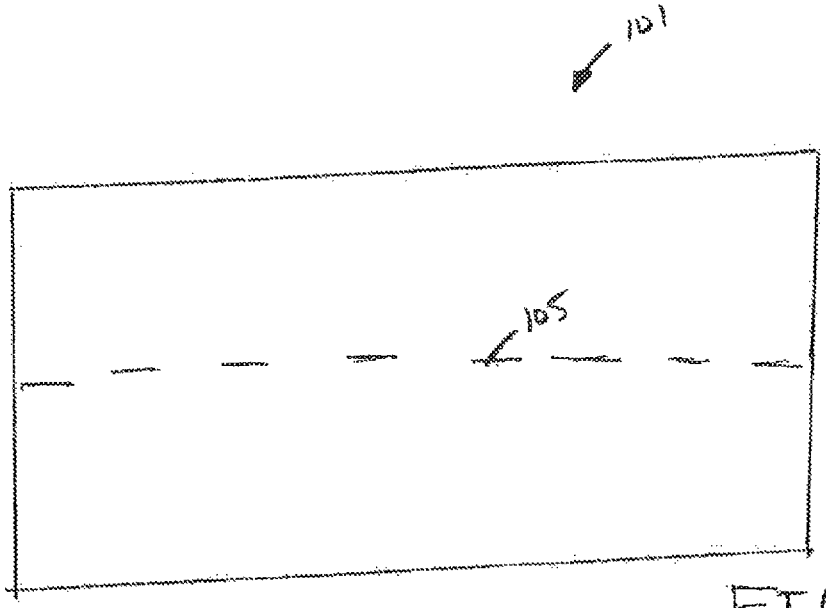
FIG. 46 is a front view of a piece of material that is unsown and unfolded that is used to form the head band used in a sixth preferred embodiment of the hair garment of the invention.
Figure 47:
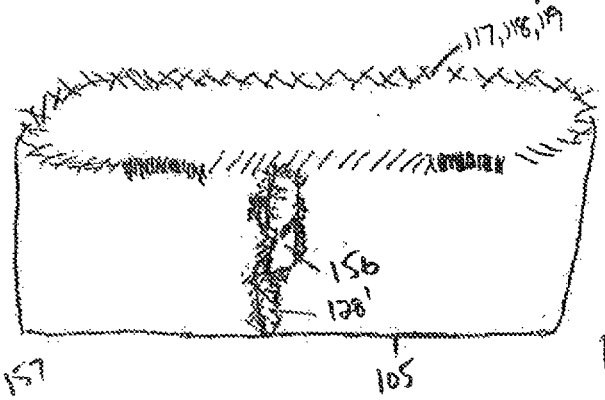
FIG. 47 is a rear view of the head band used in the sixth preferred embodiment of the hair garment of the invention.
Figure 48:
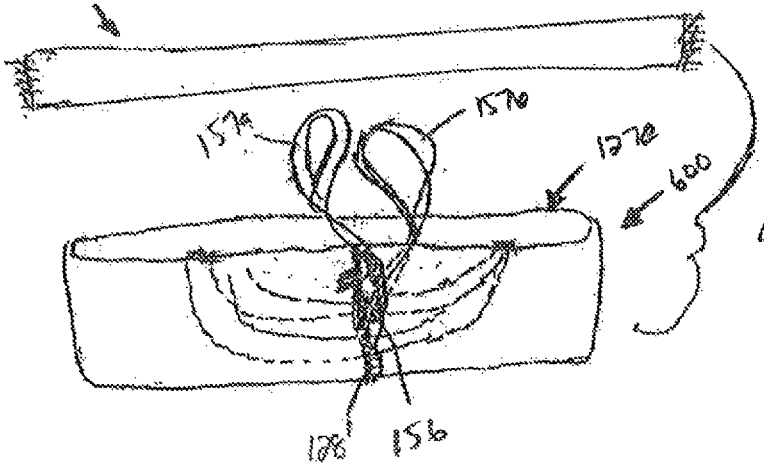
FIG. 48 is a rear view of the sixth preferred embodiment of the hair garment of the invention, along with a side view of a hair holding component used in the sixth preferred embodiment of the hair garment of the invention.

Attention is directed to FIGS. 46-48 which illustrates the sixth embodiment of the head garment 600. The head garment 600 is generally identical to the head garment 300*b*, except that the head band 127*e* has a top edge with finished seam 125 that is generally planar, rather than having a raised portion. FIG. 46 shows an unsewn pattern 101 which is folded horizontally along the center line 105. The bottom seam is thus created, then the fabric is folded, and the top seam 117, 118, 119 is sewn. One or more of the hair holding components 157 is also sewn into the top seam 117, 118, 119 and the hair holding components 157 are allowed to exit out of the opening 156 in the seam 128'.

Attention is directed to FIGS. 60-65 and 78 which illustrates the seventh embodiment of the hair garment 700. The head band 127*f* used in hair garment 700 is essentially identical to head garment 127*e* used in hair garment 600, with the exception that the opening 156 is provided along the inner layer of the seam 128' rather than the outer layer of the seam 128', thereby allowing for the opening 156 to be hidden from view when the hair garment 700 is worn by a user. Note, this embodiment is preferred over the embodiments where the opening 156 is provided along the outer layer and it is to be understood that where the opening 156 is provided along the outer layer, it could alternatively be provided along the inner layer, or vice versa.

Figure 61:
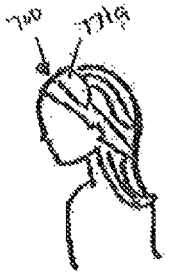
FIG. 61 is a side view of the hair garment of FIG. 60 being worn on a user's head where the visor is in a raised position.
Figure 62:
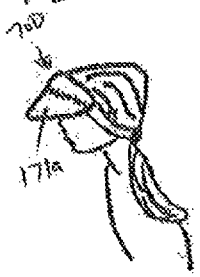
FIG. 62 is a side view of the hair garment of FIG. 60 being worn on a user's head where the visor is in a lowered position.
Figure 78:
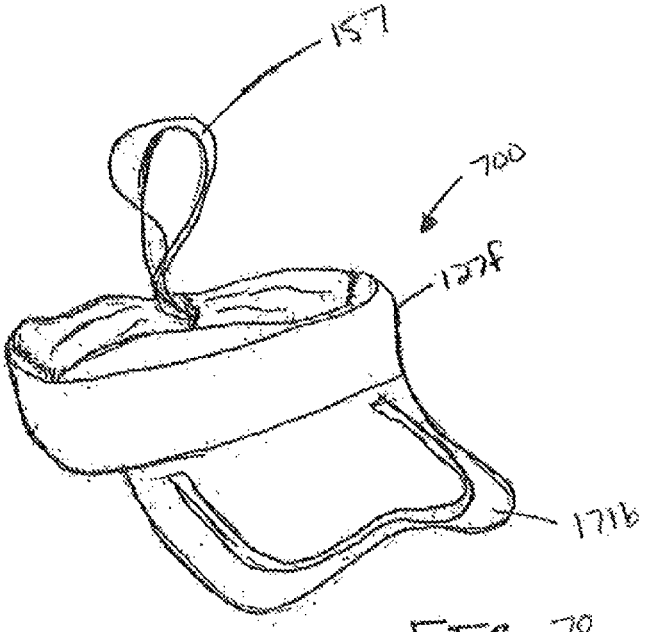
FIG. 78 is a perspective view of the seventh preferred embodiment of the hair garment of the invention.

Hair garment 700 further includes a hair holding component 157 which extends out of the opening 156 in a manner similar to that as previously described, but also includes a visor 171*a*. The visor 171*a* can be formed with a pliable material 172 enclosed in fabric 173, as illustrated in FIGS. 60-63, in order to allow for the head garment 700 to be reversible and to allow for the visor 171*a* to be adjusted by flipping it up to remove the shadow from the face, as shown in FIG. 61, or flipped down, as shown in FIG. 62. Alternatively, the hair garment 700 can have a visor 171*b* which is a standard stiff visor, of the type typically used on visors and baseball caps, as illustrated in FIG. 78.

Figure 63:
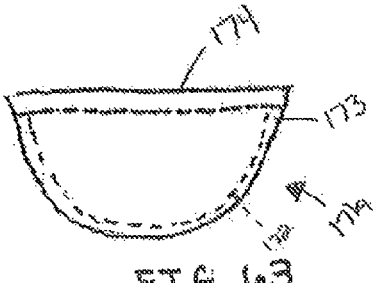
FIG. 63 is a top view of a visor used to form the seventh preferred embodiment of the hair garment of the invention.
Figure 64:
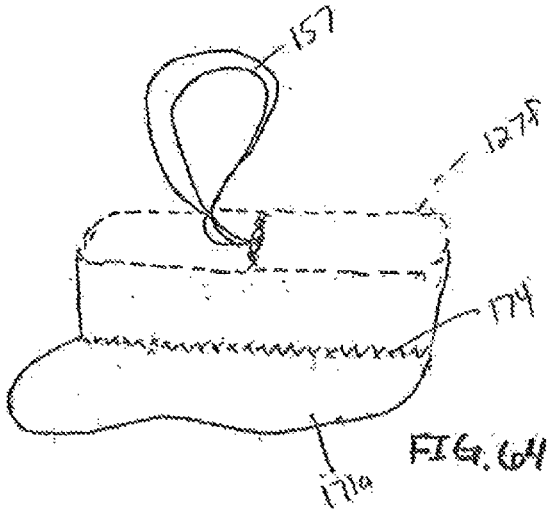
FIG. 64 is a perspective view illustrating the visor of FIG. 63 being attached to a head band to form the seventh preferred embodiment of the hair garment of the invention.

Visors 171*a*, 171*b* have straight edges 174 which are attached to the edge of the head band 127*f*, as generally illustrated in FIG. 64. The visor 171*a* can comprise a single article of material (i.e., a single plastic cut-out) or a combination of materials. For example, FIG. 63 shows a visor 171*a* that comprises fabric 173 forming an enclosure for an insert, such as pliable material 172, to be inserted therein. The insert can provide for shape, form and stiffness to the visor 171*a*. The inserted article can be formed of felt, plastic or any pliable material. The visor 171*a* can also comprise a peripheral tubing or wire (not shown) to attain shape, form and stiffness.

Figure 65:
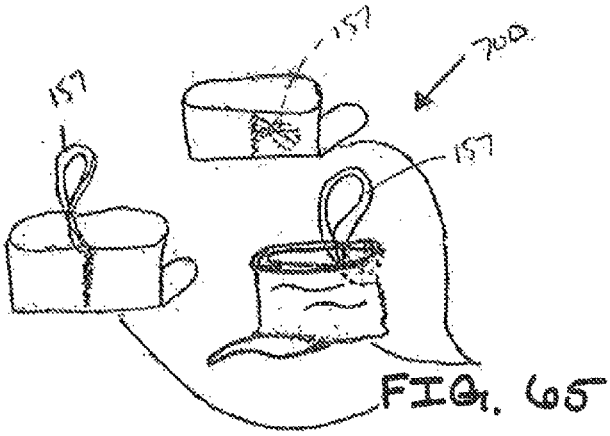
FIG. 65 is a compilation of perspective views of the seventh preferred embodiment of the hair garment of the invention.

FIG. 65 illustrates the various ways the hair holding component 157 can be attached and stored inside the head band 127*f*. The opening 156 in the head band 127*f* is preferably positioned on the interior of the circumference thereby providing an intact exterior seam, which is viewable to others when the hair holding component 157 is extended or stored within the head band 127*f*.

Figure 66:
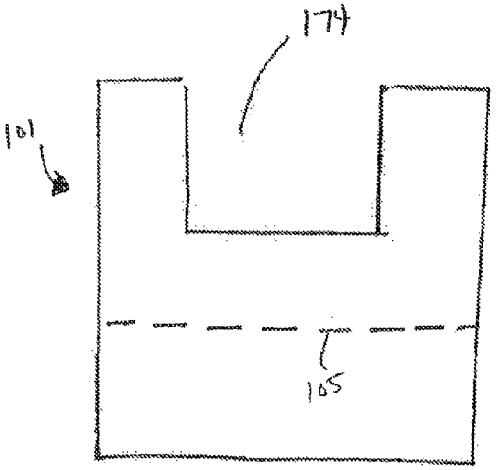
FIG. 66 is a front view of a piece of material having a cut-out portion which is used to form a headband used in an eighth embodiment of the hair garment of the invention.
Figure 67:
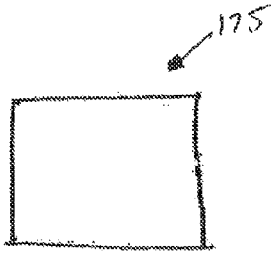
FIG. 67 is a front view of a second piece of material that is attached to the piece of material from FIG. 66.
Figure 68:
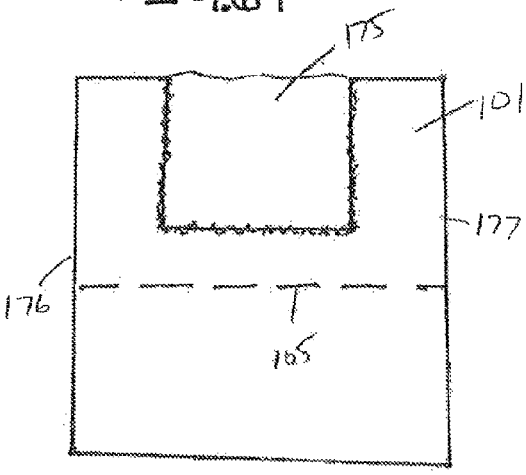
FIG. 68 is a front view of the pieces of material from FIGS. 67 and 68 joined together.
Figure 69:
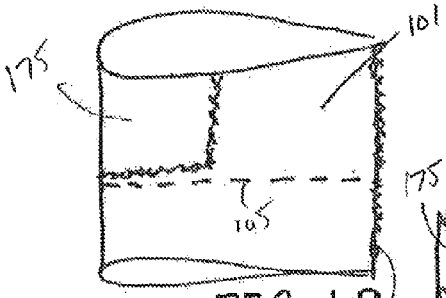
FIG. 69 is a perspective view of the pieces of material from FIG. 68 joined together at their ends.
Figure 70:
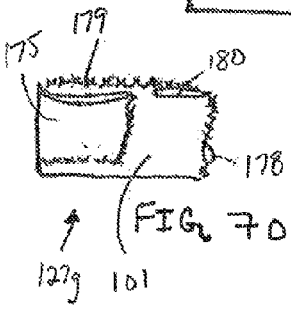
FIG. 70 is a perspective view of a head band used to form an eighth preferred embodiment of the hair garment of the invention.
Figure 71:
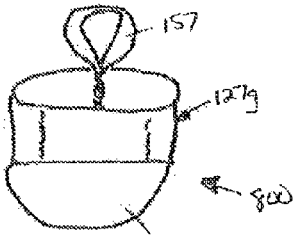
FIG. 71 is a perspective view of the eighth preferred embodiment of the hair garment of the invention.

Attention is directed to FIGS. 66-71 which illustrates the eighth embodiment of the hair garment 800. The head band 127*g* used in hair garment 800 is essentially identical to head garment 127*f* used in hair garment 700, with the exception that the headband 127*g* is formed of two pieces of material rather than just one. FIG. 66 shows a flat, cut-out head band material 101 which has a cut-out 174 that is preferably formed in the shape of a square. A second piece of material 175 (see FIG. 67), which is preferably a different material than the material of 101, is attached to the edges defined by the cut-out 174, as illustrated in FIG. 68. Edges 176, 177 are sewn together as shown in FIG. 69. A small opening 178 is created in this seam to allow for a hair holding component 157, such as a pony-tail strap, to be pulled through. Once the short seam is created, a long seam is created by folding the material 101 along its fold line 105. As shown in FIG. 70, the long seam 179 is sewn with a small portion 180 remaining unsewn. The unsewn portion 180 provides an opening which allows for the fabric to be inverted, reversing the seams. Once this reversal is complete, the opening at the small portion 180 is sewn. A visor 171 can also be attached to a front portion of the head band 127*g*. FIG. 71 shows a completely sewn head garment 800 with alternative fabric on the interior, which may act as a superior wicking fabric to be placed against a user's forehead, a visor 171 and a hair holding component 157.

Figure 58:
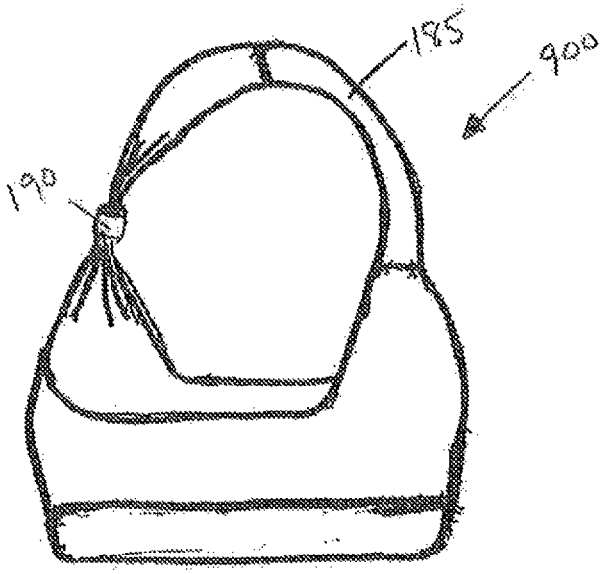
FIG. 58 is a perspective view of the ninth preferred embodiment of the head garment of the invention.
Figure 59:
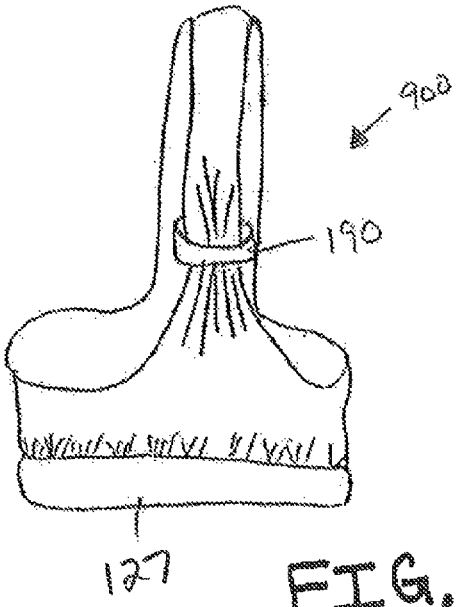
FIG. 59 is an alternative perspective view of the preferred embodiment of the ninth preferred embodiment of the head garment of the invention which includes the head band of FIG. 56 attached thereto.
Figure 60:
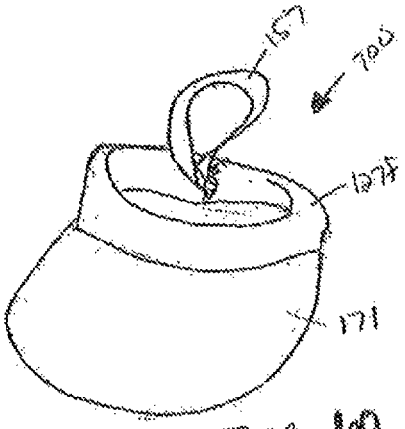
FIG. 60 is a perspective view of a seventh preferred embodiment of the hair garment of the invention.

Attention is directed to FIGS. 54-59 which illustrates the ninth embodiment of the hair garment 900. A piece of material 181 is provided which is generally E-shaped, although the middle extension 182 is longer than the end extensions 183*a*, 183*b*. Edges 184*a*, 184*b* of the end extensions 183*a*, 183*b* are sewn together. An extender top band 185 is provided which has edges 186, 187. The edge 186 is connected to edge 188 of the middle extension 182 and the edge 187 is connected to edges 189*a*, 189*b* of the end extensions 183*d*, 183*b*. An adjusting bead 190 is placed over the middle extension 182 prior to the final securement of the extender top band 185, in order to form hair garment 900. Optionally, as shown in FIG. 59, a head band 127 can be added. FIGS. 58 and 59 illustrate the hair garment 900 with the bead 190 pushed down on the front portion.

Figure 76:
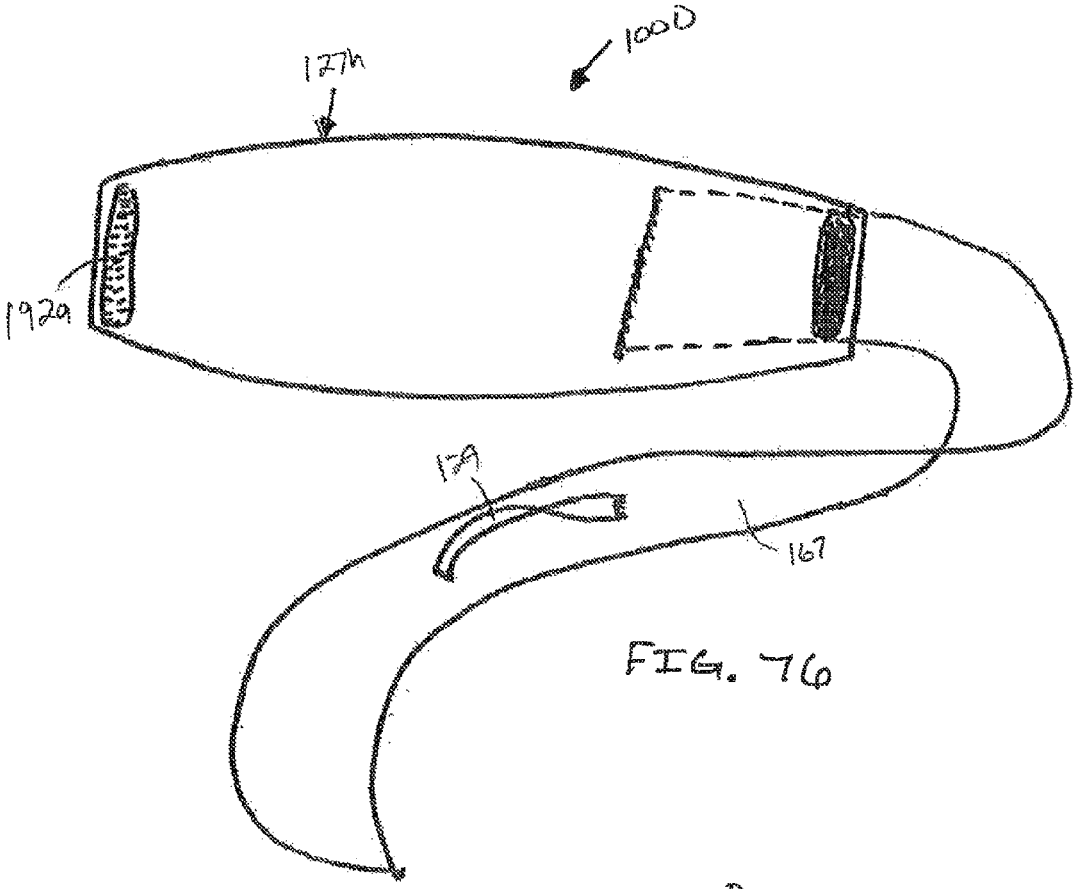
FIG. 76 shows a front perspective view of a tenth preferred embodiment of the head garment of the present invention.
Figure 77:
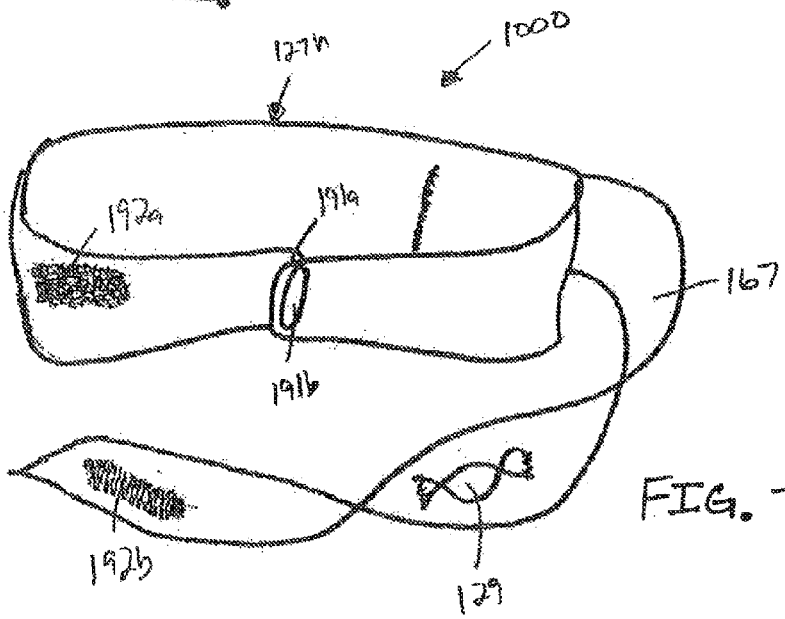
FIG. 77 shows a rear perspective view of the tenth preferred embodiment of the head garment of the present invention.

Attention is directed to FIGS. 76 and 77 which illustrates the tenth embodiment of the hair garment 1000. The hair garment 1000 utilizes a head band 127*h* which can either be formed of a single or double layer of material (as generally taught herein). Free ends of the head band 127*h* are connected to one another by complementary hook and loop devices 191*a*, 191*b* that allow a user to attach and remove the hair garment 1000 from the head as desired. The hair garment 1000 also preferably has a wrapping scarf 167 fixedly attached to an outer surface thereof. The wrapping scarf 167 preferably is removably secured from the head 127*h* at its opposite end by complementary hook and loop devices 192*a*, 192*b*. The wrapping scarf 167 may also further have a tuck band 129 attached thereto.

Figure 79:
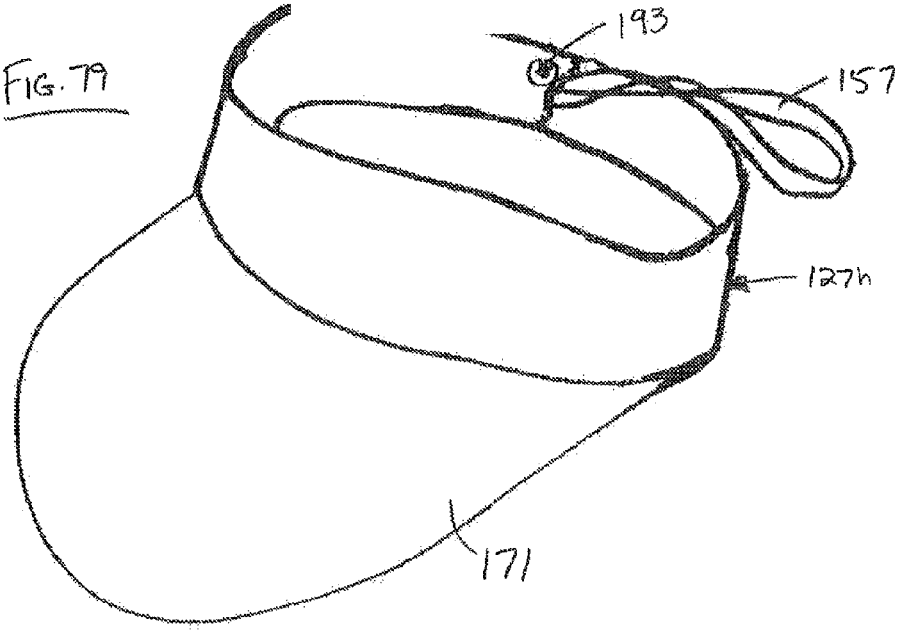
FIG. 79 is a perspective view of an eleventh preferred embodiment of the head garment of the invention, without a hair net releasably attached thereto.
Figure 80:
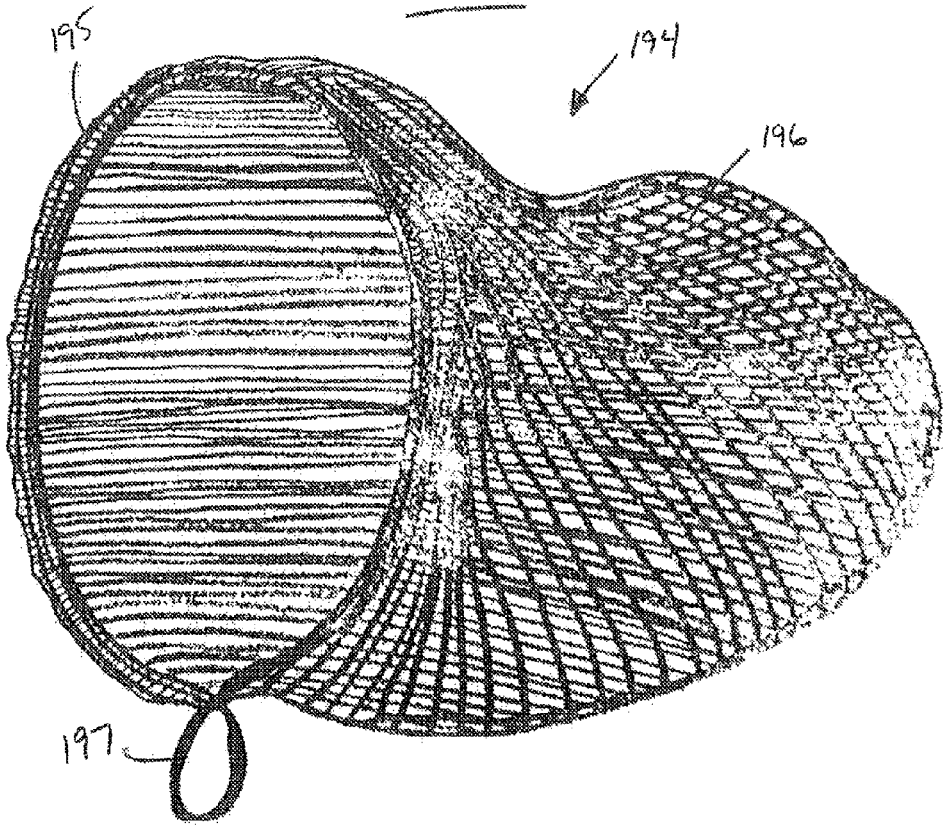
FIG. 80 is a perspective view of a hair net having a looped extension which is used to form the eleventh preferred embodiment of the head garment of the invention.
Figure 81:
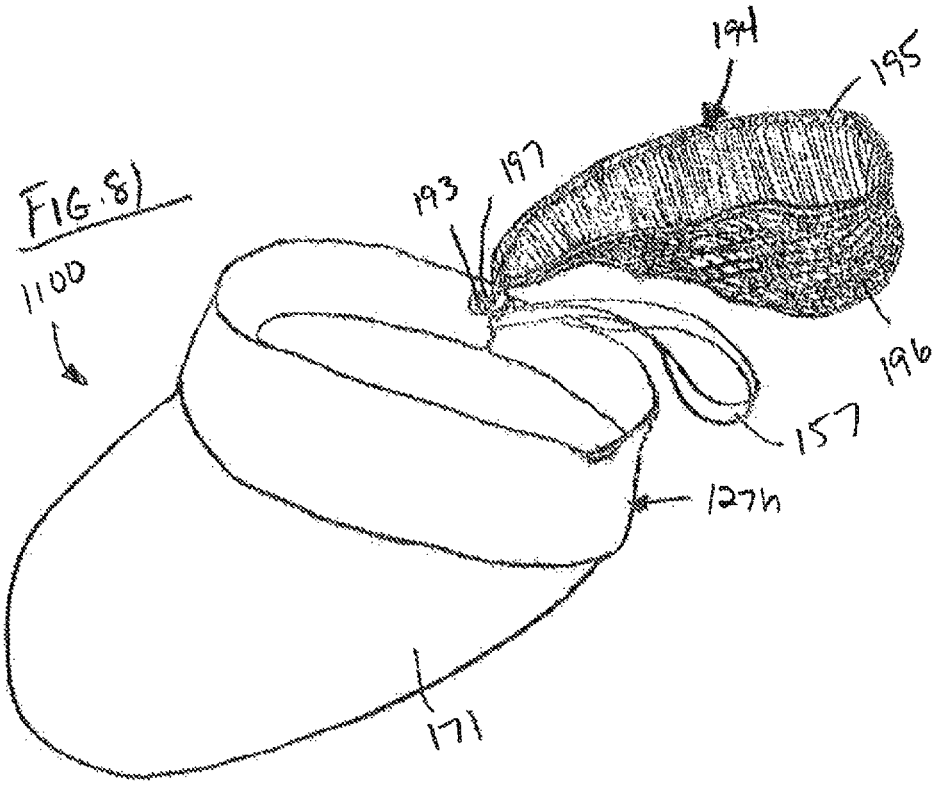
FIG. 81 is a perspective view of an eleventh preferred embodiment of the head garment of the invention, with a hair net releasably attached thereto.

Attention is directed to FIGS. 79-81 which illustrates the eleventh embodiment of the hair garment 1100. The hair garment 1100 utilizes a head band 127*h* which can either be formed of a single or double layer of material (as generally taught herein). The hair garment 1100 preferably is identical to hair garment 700 as it preferably has a visor 171 attached to a front of the head band 127*h* and a hair holding component 157 provided at a rear of the head band 127*h*. The hair garment 1100 also preferably has a button 193 or similar device fixedly secured to a rear of the head band 127*h*, preferably along an inner surface or layer of the head band 127*h*. The button 193 is provided in order to removably secure a hair net 194 (an alternative hair holding component) to the head band 127*h*. The hair net 194 is best illustrated in FIG. 80. The hair net 194 is generally formed in a manner known in the art, as it has a base stretchable portion 195 and a netting 196 attached to the base stretchable portion 195. The hair net 194, however, further includes a looped extension 197 of the base stretchable portion 195. The looped extension 197 is configured to be secured around the button 193 in order to releasably retain the hair net 194 to the head band 127*h*, thus forming the hair garment 1100. The hair garment 1100 is ideally suited for workers to wear in the food industry as they can wear the hair garment 1100 with the hair net 194 when they are working in locations where hair nets are required, but can easily remove the hair net 194 from the hair garment 1100, yet continue to wear the hair garment 1100, when they are working in locations where the hair nets are not required.

It is to be understood that modifications to the various hair garments 100, 200, 300, 400, 500, 600, 700, 800, 900, 1000, 1100 can be made as desired, where features of one of the hair garments 100, 200, 300, 400, 500, 600, 700, 800, 900, 1000, 1100 can be utilized with other features of different hair garments 100, 200, 300, 400, 500, 600, 700, 800, 900, 1000, 1100. For instance, rather than being used in conjunction with a hair holding component 157, as illustrated in FIG. 81, the hair net 194 could be utilized in hair garment 700 in place of the hair holding component 157 with the hair net 194 either be fixedly secured between the inner and outer layers, but movable to be positioned within the space between the inner and outer layers, or outside of the layers to allow for the hair net 194 to perform its desired function.

While preferred embodiments of the present invention are shown and described, it is envisioned that those skilled in the art may devise various modifications of the present invention without departing from the spirit and scope of the invention.

What is claimed:

1. A head garment comprising:

a band generally circumferential in configuration, the band comprising a closed-loop structure, the band comprising a front side and a back side, wherein the front side and the back side are separated about 180 degrees from each other about the closed-loop structure;

a hair net having a base stretchable portion and a netting secured to the base stretchable portion, the base stretchable portion adapted to stretch around a head of a person wearing the head garment so that the hair net contains hair covering the head of the person;

a visor attached to the front side of the band; and a single button fixedly attached to the back side of the band, the single button adapted to removably attach the hair net to the band.

2. The head garment of claim 1, wherein the hair net comprises a looped extension configured to be secured around the single button in order for the hair net to be removably attached to the band.

3. The head garment of claim 1, further comprising another band, at least one ribbon, a strap, a string, or a scarf.

4. The head garment of claim 1, wherein the band has free ends affixed to one another along a sewn seam.

5. The head garment of claim 4, wherein the sewn seam comprises a first sewn seam, and wherein the band is formed of a piece of material that is folder over on itself along a generally horizontal fold line to define inner and outer layers and top and bottom edges of the band, the generally horizontal fold line being provided at one of the top and bottom edges, the inner and outer layers being affixed to one another along a second sewn seam proximate the other one of the top and bottom edges, the inner and outer layers each having free ends affixed to one another along the first sewn seam, the first sewn seam extending from the second sewn seam to the generally horizontal fold line along each of the inner and outer layers.

6. The head garment of claim 1, wherein the single button is fixedly attached to an inner surface of the band.

7. The head garment of claim 1, wherein the band comprises a first material and further comprises a cutout, and wherein the head garment further comprises a piece comprising a second material, the piece being attached to edges defined by the cutout.

* * * * *